US006588521B1

(12) United States Patent
Porubcansky et al.

(10) Patent No.: US 6,588,521 B1
(45) **Date of Patent: *Jul. 8, 2003**

(54) FOUR TRACK CRAWLER CRANE

(75) Inventors: Kenneth J. Porubcansky, Whitelaw, WI (US); David J. Pech, Manitowoc, WI (US); Alan E. Pleuss, Manitowoc, WI (US)

(73) Assignee: Manitowoc Crane Companies, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/277,364

(22) Filed: Mar. 26, 1999

Related U.S. Application Data

(60) Provisional application No. 60/079,727, filed on Mar. 27, 1998.

(51) Int. Cl.[7] ..... B66C 23/36

(52) U.S. Cl. ..... 180/9.1; 180/9.44; 212/175; 212/180

(58) Field of Search ..... 180/9.1, 9.21, 180/9.23, 9.26, 9.32, 9.4, 9.42, 9.44, 9.46, 9.48; 212/180, 175, 9.25, 9.34, 9.5, 9.52, 9.62, 9.64

(56) References Cited

U.S. PATENT DOCUMENTS

| | | | | |
|---|---|---|---|---|
| 1,804,816 A | * | 5/1931 | Shelton | 180/9.46 |
| 2,296,659 A | * | 9/1942 | Bates et al. | 180/9.5 |
| 3,036,650 A | | 5/1962 | Cimino | |
| 3,166,138 A | * | 1/1965 | Dunn, Jr. | 180/65.6 |
| 3,638,805 A | | 2/1972 | Garnier | |
| 3,696,879 A | * | 10/1972 | Terai et al. | 180/9.48 |
| 3,820,616 A | * | 6/1974 | Juergens | 180/9.48 |
| 3,946,822 A | * | 3/1976 | Dohse et al. | 180/9.46 |

(List continued on next page.)

FOREIGN PATENT DOCUMENTS

| | | |
|---|---|---|
| DE | 479 760 | 7/1929 |
| DE | 1 111 037 | 7/1961 |
| DE | 25 17 203 | 10/1976 |
| DE | 29 49 279 | 6/1981 |
| GB | 2 053 146 | 2/1981 |
| GB | 2 053 146 A * | 2/1981 |

OTHER PUBLICATIONS

"Demag CC 2600 Brochure," published by Mannesmann Demag Fordertechnik, pp. 1–10. While the date of publication is unknown, it is believed that the Brochure was published prior to Mar. 27, 1998.

"Demag CC 4800 Brochure," published by Mannesmann Demag, pp. 1–10. While the date of publication is unknown, it is believed that the Brochure was published prior to Mar. 27, 1998.

"Liebherr LR 1550 Brochure," published by Liebherr, 8 pages. While the date of publication is unknown, it is believed that the Brochure was published in 1993.

"Liebherr LR 1650 Brochure," published by Liebherr, 8 pages. While the date of publication is unknown, it is believed that the Brochure was published prior to Mar. 27, 1998.

*Primary Examiner*—Paul N. Dickson
*Assistant Examiner*—Ruth Ilan
(74) *Attorney, Agent, or Firm*—Brinks Hofer Gilson & Lione

(57) ABSTRACT

A crawler that includes a first crawler assembly and a second crawler assembly attached to the first crawler assembly so that the first crawler assembly is aligned with the direction of travel of the second crawler assembly.

20 Claims, 25 Drawing Sheets

U.S. PATENT DOCUMENTS 3,998,286 A * 12/1976 Ponikelsky et al. ..... 180/9.48
4,000,784 A 1/1977 Morrow, Sr. et al.
4,171,023 A * 10/1979 Sturges ..... 172/292
4,174,757 A * 11/1979 Stedman ..... 180/9.46
4,231,699 A 11/1980 Thompson
4,266,679 A 5/1981 Juergens
4,324,304 A 4/1982 Hashimoto et al.
4,387,814 A * 6/1983 Bedhuhn et al. ..... 180/9.46
4,431,074 A 2/1984 Langerud
4,445,582 A * 5/1984 Andersson ..... 180/9.5
4,579,182 A * 4/1986 Dewing et al. ..... 180/9.46
4,625,820 A 12/1986 Christian
4,645,023 A * 2/1987 Rea et al. ..... 180/9.32
5,113,958 A * 5/1992 Holden ..... 180/9.4
5,148,929 A 9/1992 Wernecke et al.
5,189,605 A 2/1993 Zuehlke et al.
5,199,586 A 4/1993 Pech et al.
5,292,016 A 3/1994 Casavant et al.
5,297,019 A 3/1994 Zuehlke
5,427,256 A 6/1995 Kleppe
5,435,405 A * 7/1995 Schempf et al. ..... 180/9.1
5,579,931 A 12/1996 Zuehlke et al.
5,649,635 A 7/1997 Casavant et al.
5,823,279 A 10/1998 Petzold
6,010,018 A 1/2000 Pech

* cited by examiner

FOUR TRACK CRAWLER CRANE

This application claims the benefit of U.S. provisional application No. 60/079,727, filed Mar. 27, 1998.

BACKGROUND OF THE INVENTION

1. Field of The Invention

The present invention generally relates to crawler cranes. Specifically, the present invention relates to crawler cranes with four crawler assemblies.

2. Discussion of Related Art

A crawler crane is a heavy duty machine which is used to lift, transport and place heavy loads, often exceeding 100 tons, from one place to another at a work site. As construction projects get more ambitious in scale, a need for crawler cranes that can lift, transport and place loads exceeding over 300 tons has developed.

An example of a crane that can lift over 300 tons is described in German Offenlegungsschrift 2 517 203 ("the '203 German reference"). In particular, the '203 German reference describes a crawler crane that has four dual track crawler units. Each crawler unit is not directly connected to another crawler unit and is connected to the housing 8 via an outrigger. The tracks in each crawler unit are driven at different speeds and/or directions with respect to each other.

The crawler crane described in the '203 German reference suffers from several disadvantages. For example, the assembly and disassembly of the crawler crane at a work site can be complex and time consuming. Similarly, the transport of the crawler crane from one job site to another can be difficult. The crawler crane also has limited mobility during movements performed irrespective of whether or not a load is being lifted by the crawler crane.

The described crawler crane suffers from several other disadvantages. For instance, it provides inadequate ground bearing pressures at the crawler assemblies for various forms of turning the crawler crane. The crawler crane described in the '203 German reference also provides inadequate lifting characteristics by constraining its fulcrum points to be located over the centers of the crawler units.

SUMMARY OF THE INVENTION

The present invention regards a carbody and crawler assembly where the carbody includes a first beam with a first end and a second beam with a first end. A first crawler assembly is attached to the first end of the first beam and a second crawler assembly is attached to both the first crawler assembly and the first end of the second beam.

A second aspect of the present invention regards a crawler that includes a first crawler assembly and a second crawler assembly attached to the first crawler assembly, wherein the second crawler is aligned with the direction of travel of the first crawler assembly.

A third aspect of the present invention regards a method of assembling a first crawler assembly to a second crawler by positioning a first crawler assembly adjacent to a second crawler assembly and attaching the first crawler assembly to the second crawler assembly so that the first crawler assembly is aligned with the direction of travel of the second crawler assembly.

Each aspect of the present invention provides for a simpler design for a large load capacity crawler crane that reduces the complexity and time used to assemble, disassemble and transport the large load capacity crawler crane. Each aspect of the present invention also provides improved mobility for large load capacity crawler cranes during movements performed irrespective of whether or not a load is being lifted by the crawler crane.

Each aspect of the present invention also provides both adequate ground bearing pressures at the crawler assemblies used for turning the crawler crane. In addition, each aspect of the present invention provides adequate lifting characteristics by providing a larger fulcrum distance than other large load capacity crawler cranes, such as the crawler crane described in the '203 German reference.

The foregoing features and advantages of the present invention will be further understood upon consideration of the following detailed description of the invention taken in conjunction with the accompanying drawings, in which:

DESCRIPTION OF THE PREFERRED EMBODIMENTS

The preferred embodiment of the present invention relates to a four track crawler crane, other aspects of which are disclosed in U.S. Pat. Nos. 5,148,929; 5,189,605; 5,199,586; 5,292,016; 5,297,019; 5,427,256; 5,579,931; 5,649,635 and copending U.S. patent application Ser. No. 08/826,627, filed Apr. 3, 1997 that are assigned to the assignee of the present application and the entire contents of the above mentioned U.S. patents and application are hereby incorporated herein by reference.

Figure 1:
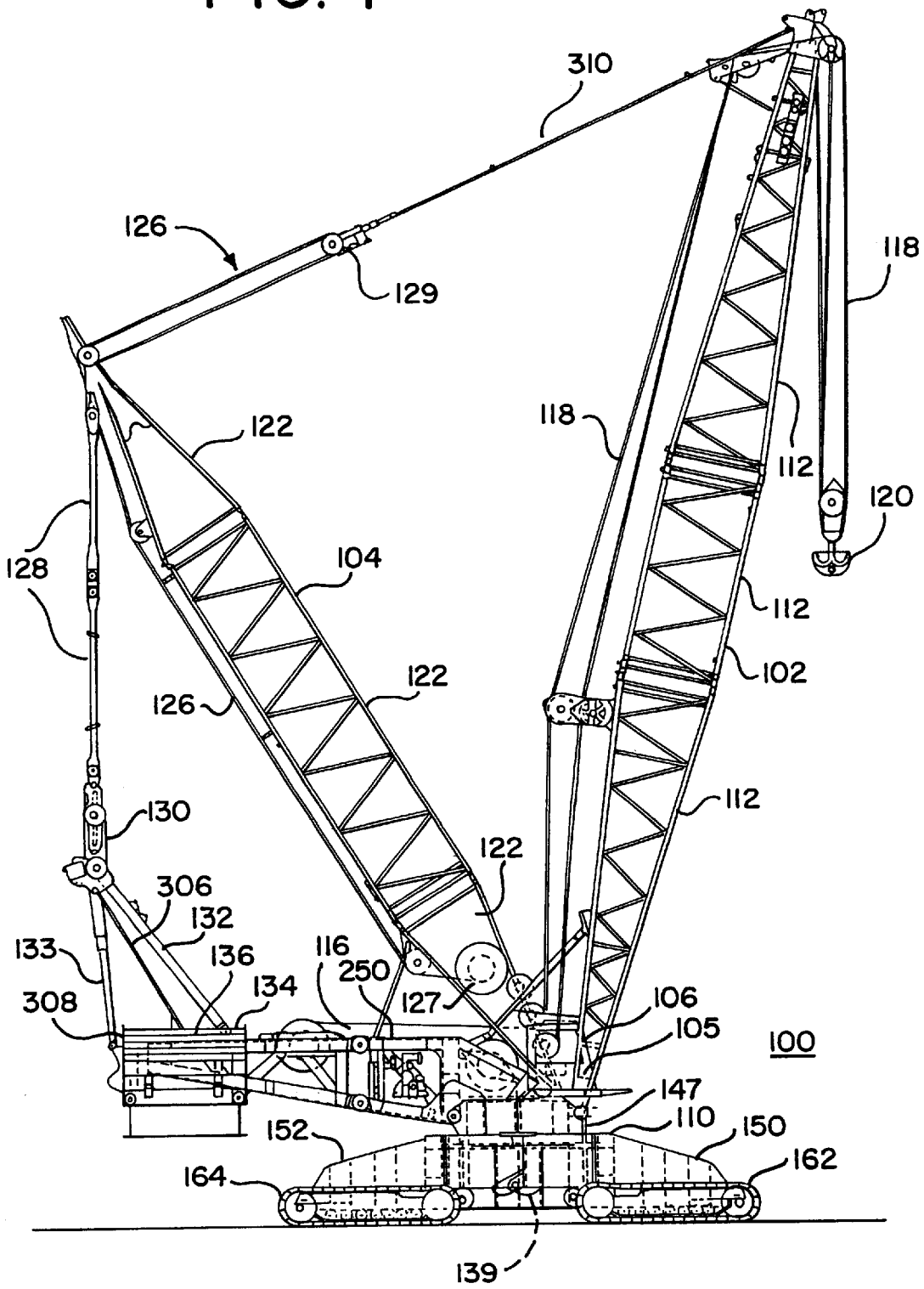
FIG. 1 shows a right side view of an embodiment of a crawler crane according to the present invention.

The crawler crane of the present invention is best understood by a review of FIGS. 1 and 3–9. In particular, FIG. 1 shows a 640 ton crawler crane 100 that basically has five main components: (1) a crane boom 102; (2) a mast 104; (3) a superstructure 105 that includes and operator's cab 106; (4) four sets of crawler assemblies 162, 164, 166, 168; and (5) a carbody 110. The 45 ton crane boom 102 is connected to the one end of the superstructure 105 and extends into the air above the operator's cab structure. The crane boom 102 is made of three frames 112 made of high strength steel that are attached to one another in a well known manner so as that the crane boom 102 has a total length of approximately 125 feet. The crane boom 102 also includes a wire rope system 118 that includes a hook block 120 attached to one end thereof enabling the lifting of an object (not shown) from the ground into the air.

Figure 10A:
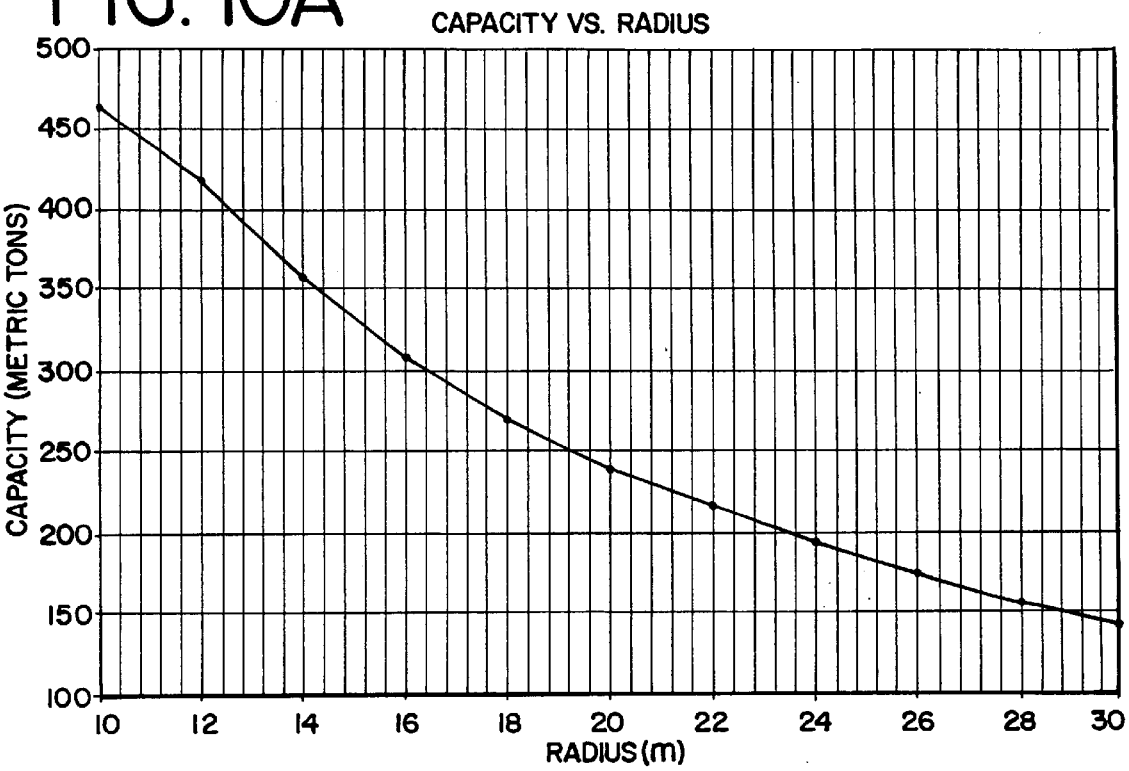
FIG. 10A shows a lift capacity v. load radius graph when a crawler crane embodying the present invention uses a 45.7 m superstructure.
Figure 10B:
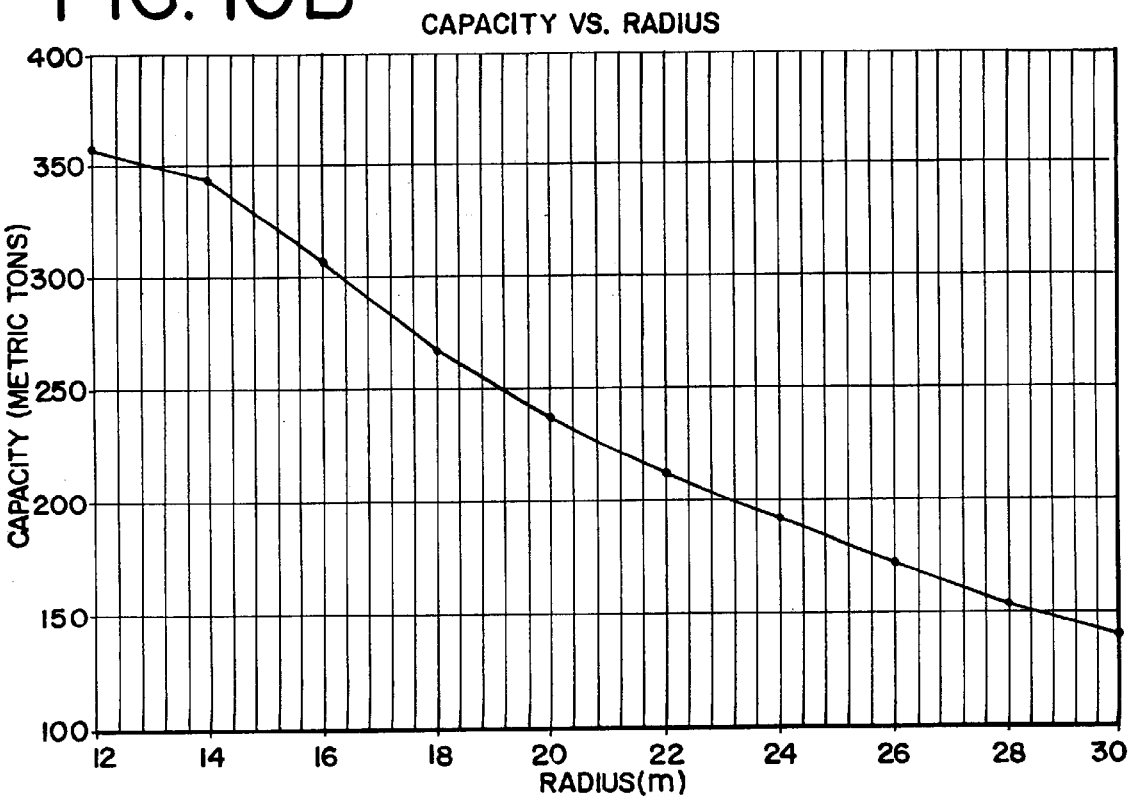
FIG. 10B shows a lift capacity v. load radius graph when a crawler crane embodying the present invention uses a 68.6 m superstructure.
Figure 10C:
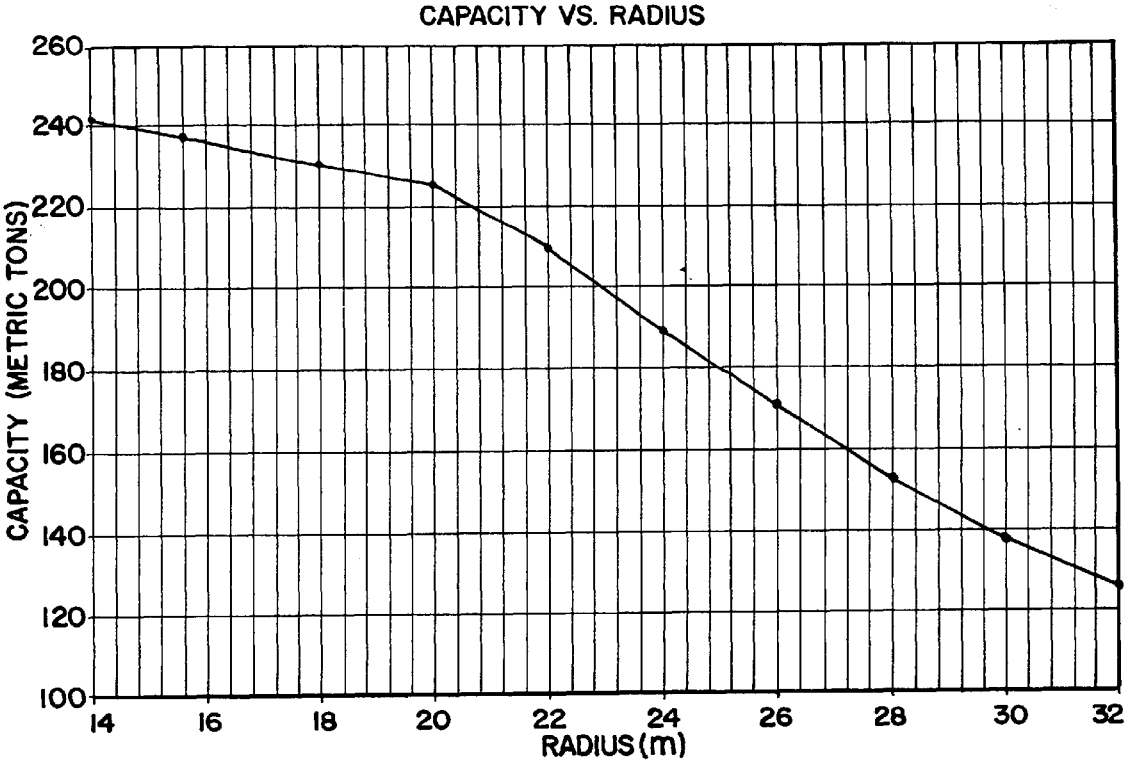
FIG. 10C shows a lift capacity vs. load radius graph when a crawler crane embodying the present invention uses a 91.4 m superstructure.

The mast 104 is attached to the superstructure 105 in a manner similar to the attachment of the crane boom 102 to the superstructure 105. The mast 104 weighs approximately 36 tons and is composed of three frames 122 made of high strength steel that are attached to one another so as to have a total length of approximately 80 feet. The length of the mast 104, along with the overall size of the crawler crane 100, is one of the factors that allows the crawler crane 100 to lift greater loads for a given load radius when compared with existing crawler cranes that can lift over 100 metric tons. The lift capacity of the present invention for various booms and load sizes is shown in FIGS. 10A–C. As shown in FIG. 1, the crane boom 102 is raised and lowered by a second wire rope system 126 that is attached at one end to a boom hoist drum 127 and at another end to an equalizer 129 that is attached to the top of the crane boom 102. Accordingly, rotation of the boom hoist drum 127 results in the changing of the position of the crane boom 102. The top of the mast 104 is attached to a two pairs of back hitch straps 128 that are connected via the equalizer 130 to a mast raising gantry 132 and a back hitch 133 that are in turn attached to the rear part 134 of the rotating bed 116. To provide further stability for larger loads, a counterweight 136, having a weight of approximately 240 tons, can be positioned on the rear part 134 of the rotating bed 116 so as to be approximately 35 feet from the rotation axis 139 of the rotating bed 116.

Figure 2:
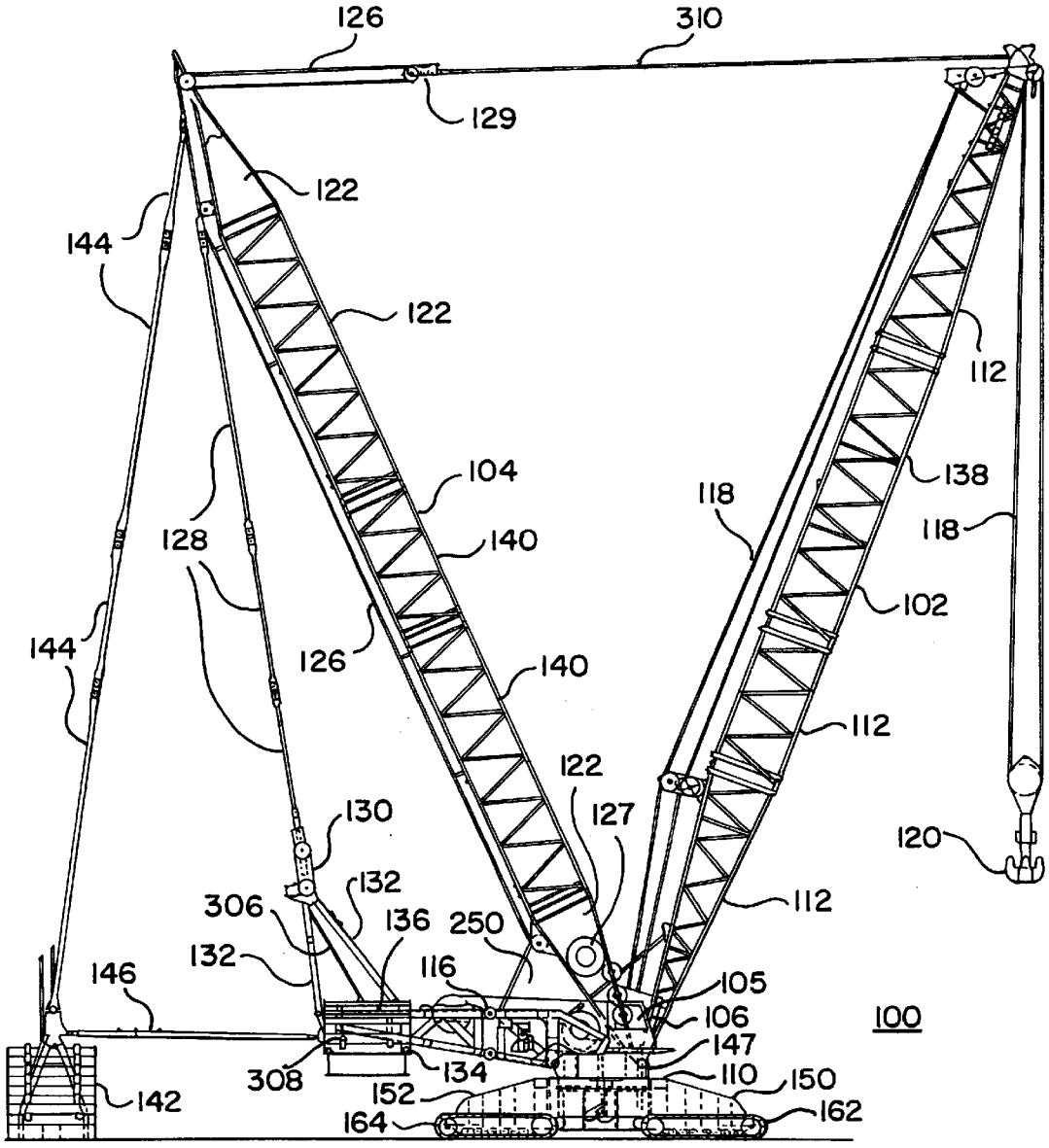
FIG. 2 shows a right side view of a second embodiment of a crawler crane according to the present invention.

The crawler crane 100 of FIG. 1 is able to lift loads up to 600 metric tons. If loads ranging from 600 to 800 metric tons are to be lifted, then the crawler crane 100 of FIG. 1 can be modified lengthening the crane boom 102 to a length of approximately 140 feet by adding a single section 138, as shown in FIG. 2. The mast 104 is also lengthened by adding a pair of sections 140 so that the total length is approximately 140 feet. Note that the sizes of the frames 112 and 122 and their constituent components for the crane boom 102 and the mast 104 of FIG. 2 may differ from those of FIG. 1 so as to provide additional structural integrity. A second counterweight 142 may or may not be used depending on the desired application for the crawler crane 100. When in use, the second counterweight 142 has a weight that can range up to 500 metric tons so as to provide better stability to the crawler crane 100 by being attached to both the top of the mast 104 and the other counterweight 136 via straps 144 that are similar to straps 128 and a compression frame 146 so as to be approximately 72 feet from the rotation axis 139. The modified crawler crane 100 of FIG. 2 has a total weight of approximately 1200 tons.

As mentioned previously, the crane boom 102 is attached to the superstructure 105. The superstructure 105 supports an operator's cab 106 and an engine. From the operator's cab 106, a human operator is able to control the various wire ropes used to raise or lower the crane boom 102, the mast 104 or an object. The carbody 110 has a slewing bearing 147 which enables the superstructure 105 to rotate on the carbody 110. From inside the operator's cab 106, a human operator is able to control the amount of movement and rotation of the superstructure 105.

Figure 3:
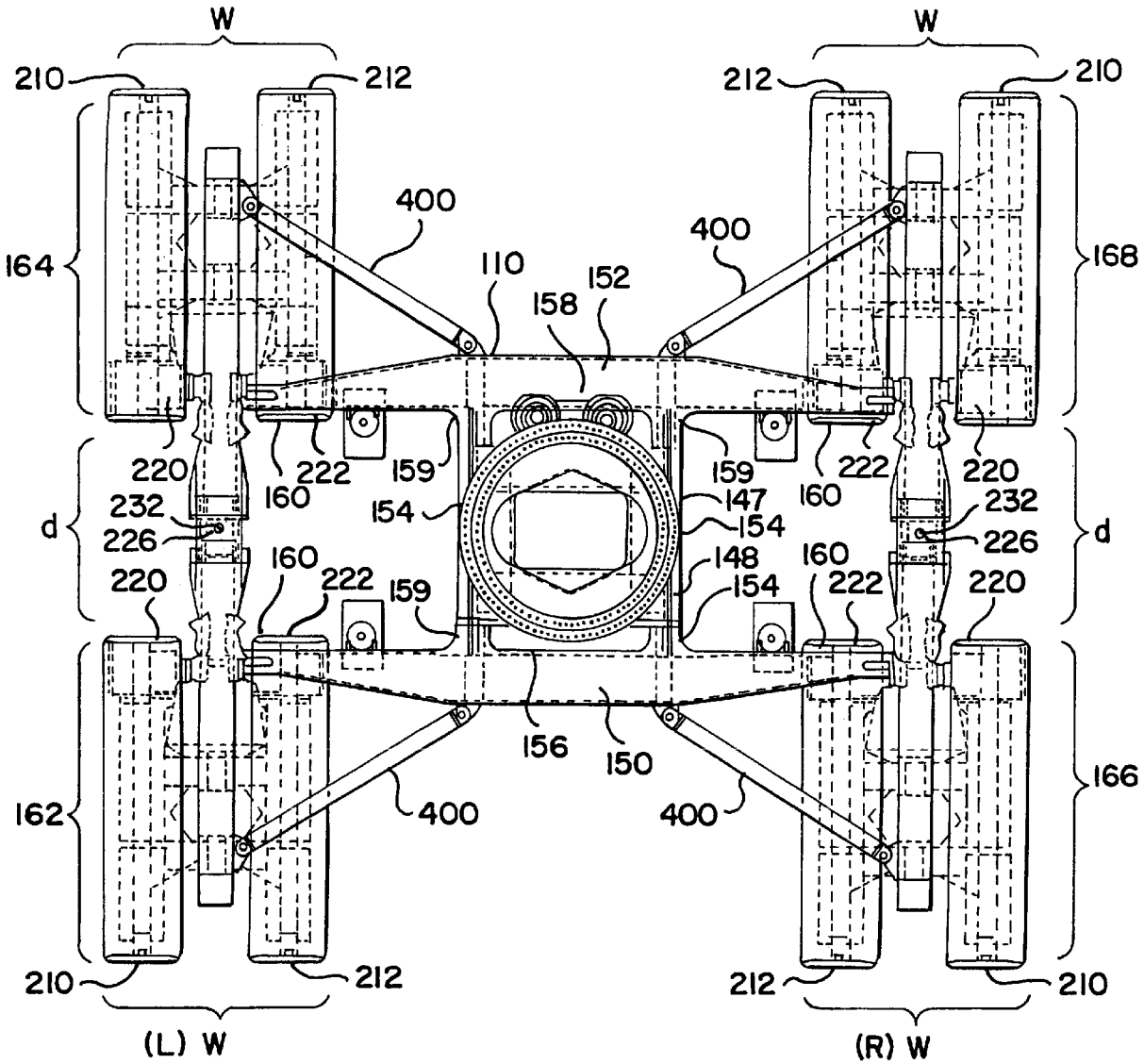
FIG. 3 shows a top view of a carbody and crawler assembly system to be used with the crawler cranes of FIGS. 1–2.
Figure 8A:
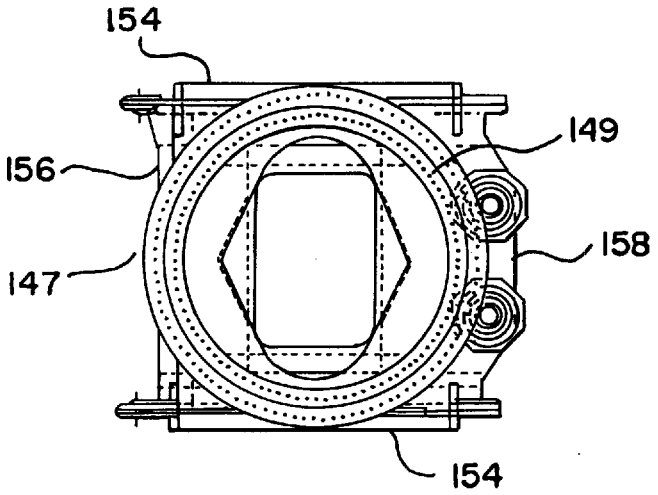
FIGS. 8A–O show the progressive assembly of the crawler crane of FIG. 1.
Figure 8B:
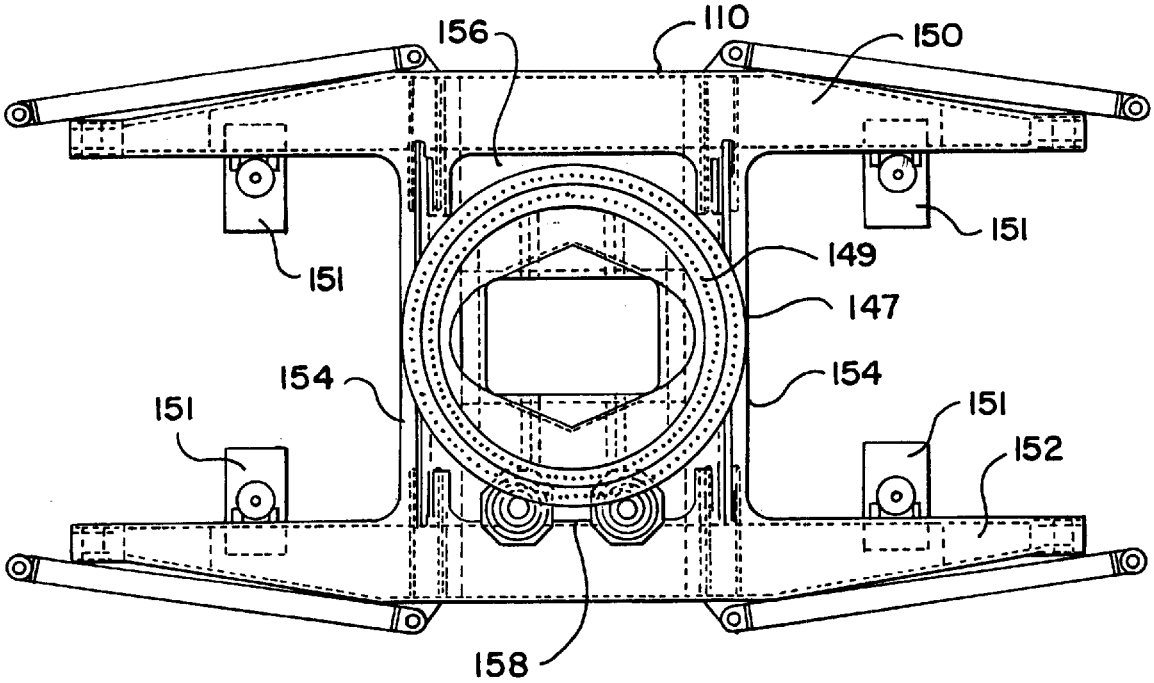
Figure 8C:
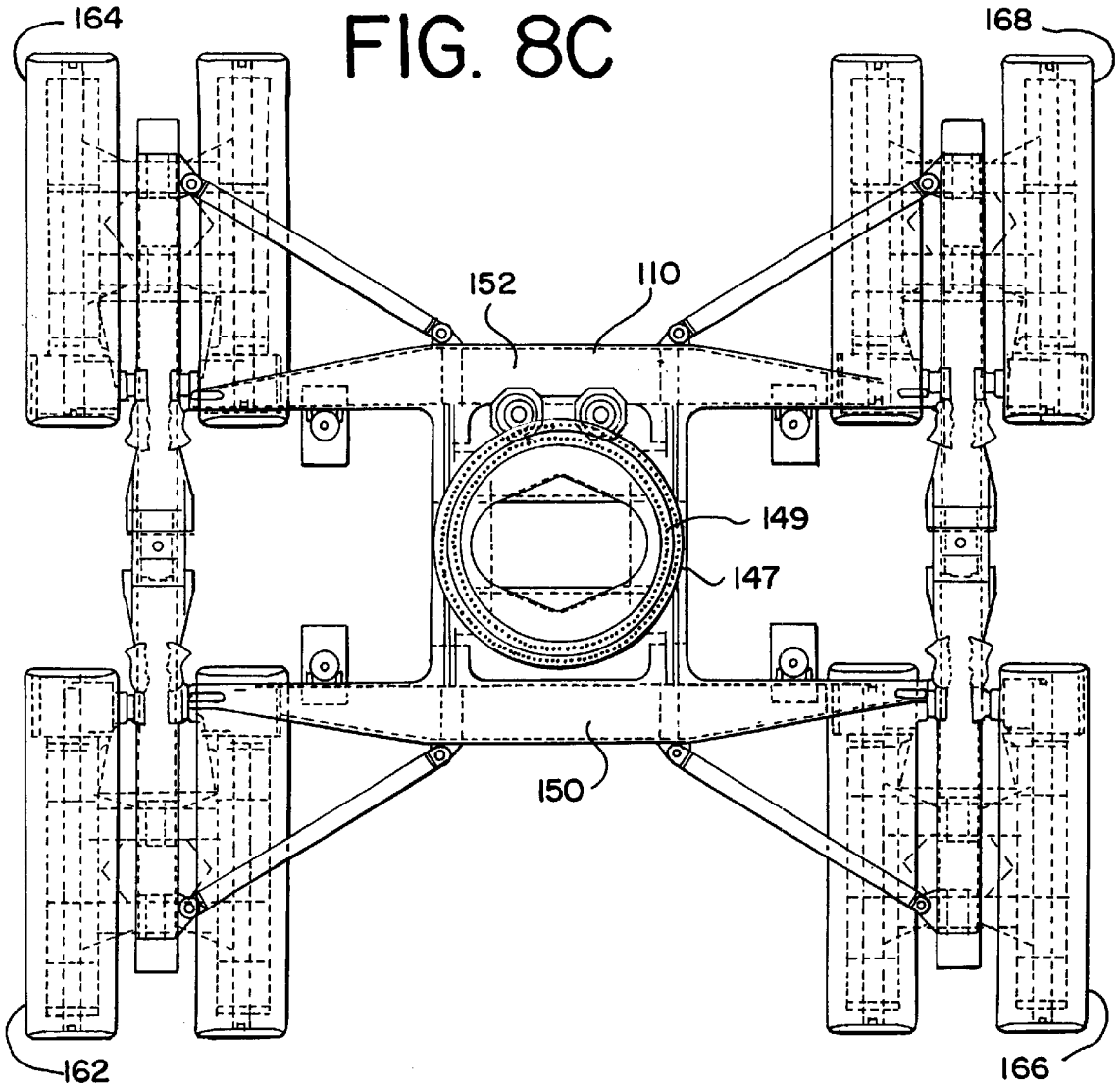

As shown in FIGS. 3, 8A and 8C, the carbody 110 is generally H-shaped with a rectangular central support structure 148 that is integrally attached to a pair of identically shaped parallel beams 150, 152 that are perpendicular to the lateral sides 154 of the central support structure 148. The carbody 110 preferably is made of a welded high strength steel plate and has a weight of approximately 36 ton. Each of the lateral sides 154 have a length of approximately 13 feet while the front and rear sides 156, 158 of the central support structure 148 each have a length of approximately 3.5 m and a height of approximately 6 feet. Each beam 150, 152 has a length of approximately 33.5 feet, a width of approximately 5.5 feet and a height of approximately 7 feet. The beams 150 and 152 each weigh approximately 16.5 tons and are symmetrically positioned about the vertical plane of symmetry that bisects the front and rear sides 156, 158 of the central support structure 148.

Figure 5C:
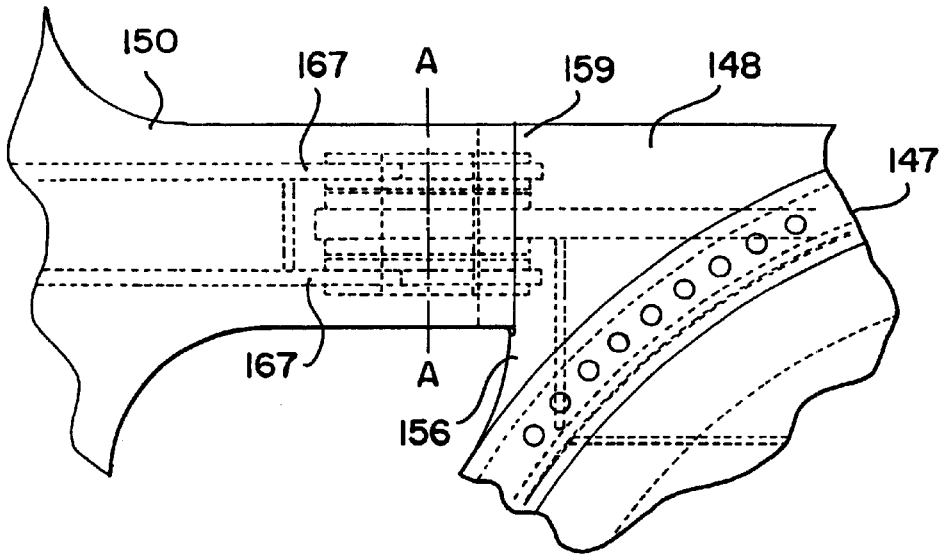
FIG. 5C shows a top view of the connection between the central support structure and the beam of the carbody of FIGS. 5A–B.
Figure 5D:
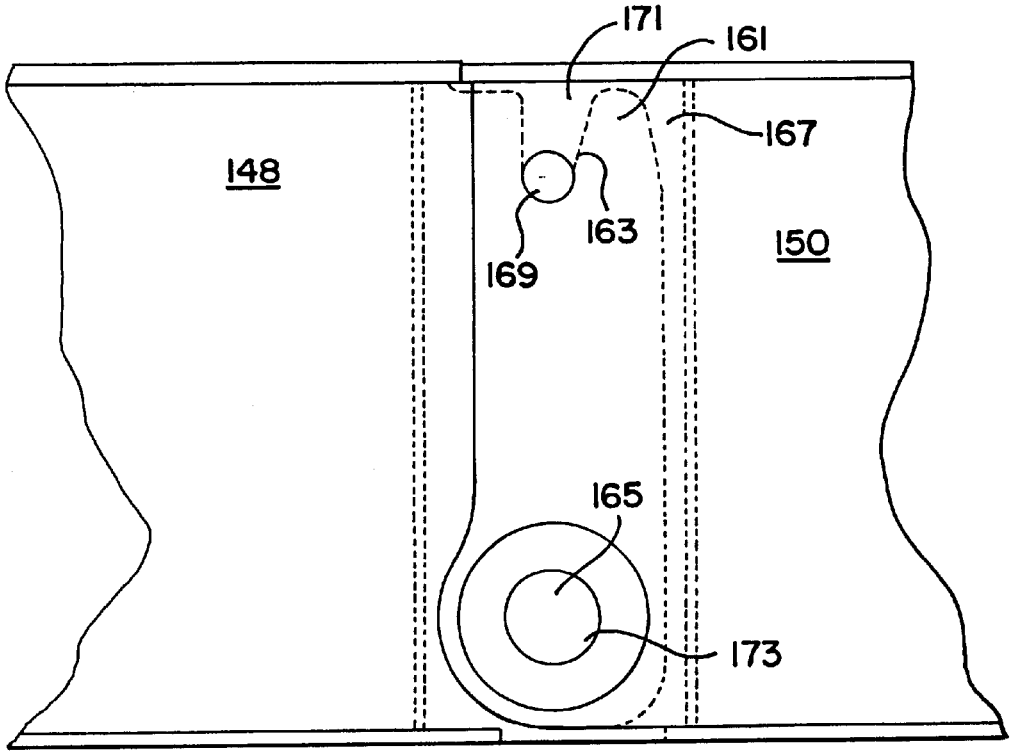
FIG. 5D shows a sectional view of the connection of FIG. 5C taken along line A—A of FIG. 5C.

As shown in FIG. 3, the central support structure 148 has four attachment extensions or beams 159 that are arranged to support the beams 150 and 152. While the attachment of the beam 150 to the central support structure 148 will be described below, it is understood that the attachment of the beam 152 to the central support structure 148 is accomplished in the same manner. As shown in FIGS. 5C and 5D, the attachment beams 159 of the front side 156 of the central support structure 148 have a pair of vertical plates 161, where each plate 161 include an upper female receptor such as hook 163 and a lower opening 165. The front beam 150 has a pair of male insertion pieces 167 that are inserted between the plates 161. Each insertion piece 167 has a lower opening 173 and pair of pins 169 that are located on the parallel lateral sides 171 of the insertion piece 167. As the two male insertion pieces 167 are lowered between the vertical plates 161, via a crane, the pins 169 engage the bottom of the openings of the hooks 163 and the beam 150 pivots about the pins 169 until it reaches the position shown in FIG. 5D where the openings 165 and 173 are aligned with each other. A pair of pins are inserted into the aligned openings 165 and 173 so as to attach the beam 150 to the central support structure 148.

Figure 7A:
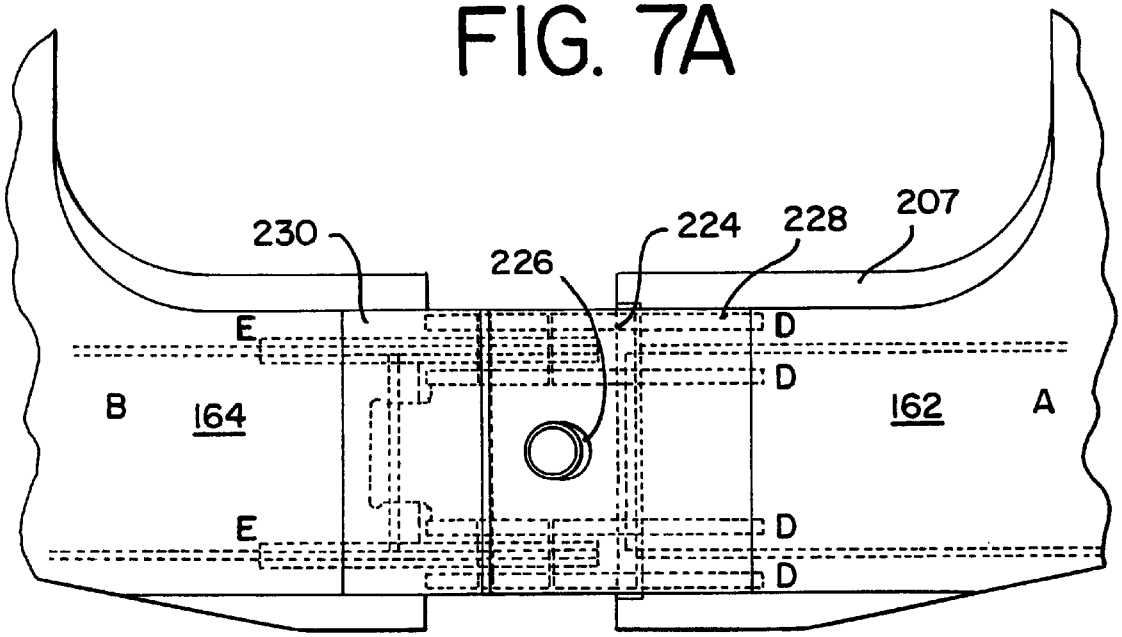
FIG. 7A shows a top view of the connection between two aligned crawler assemblies used with the crawler cranes of FIGS. 1–3 and 13–14.
Figure 7B:
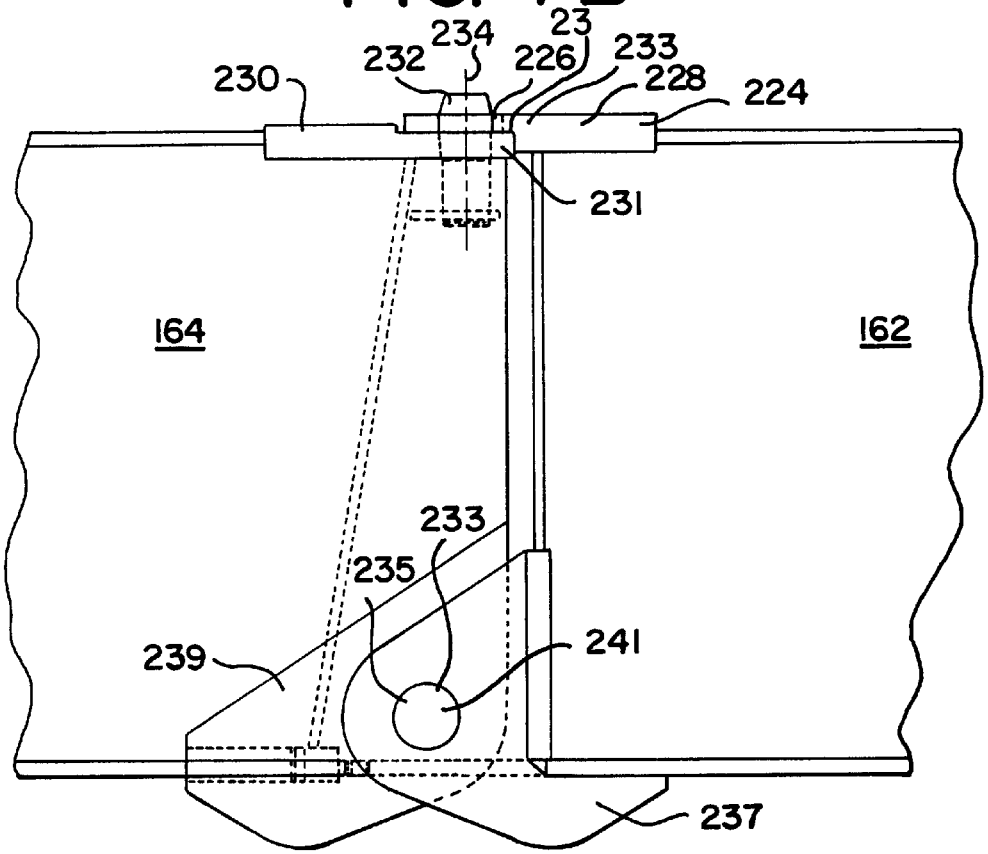
FIG. 7B shows a side cross-sectional view of the connection of FIG. 7A taken along line B—B of FIG. 7A.

The left, front crawler assembly 162, the left, rear crawler assembly 164, the right, front crawler assembly 166 and the right, rear crawler assembly 168 are separate components so as to be easy to transport to a work site. Before the front and rear crawler assemblies are attached to the carbody 110, they are attached to one another via a connector. While the discussion to follow regards the attachment of the left, front crawler assembly 162 to the left, rear crawler assembly 164, it is equally applicable to the connection between the crawler assemblies 166 and 168. As shown in FIGS. 7A–B, the rear end 224 of the upper attachment structure 207 of the front crawler assembly 162 includes a horizontal female receiving member, such as the elongated opening 226 formed in the horizontal plate 228 of the front crawler assembly 162. The front end 230 of the upper attachment structure 207 of the rear crawler assembly 164 includes a male attachment device, such as a vertical, stationary pivot point element like the vertically extending pin 232. The top of the pin 232 preferably is chamfered. The opening 226 and the pin 232 have a cooperating shape that ensures that the pin 232 will extend through the opening 226 when the front crawler assembly 162 is positioned above the rear crawler assembly 164 at a range of angles from 0 to 45 degrees or 0 to 15 degrees, preferably 5 to 15 degrees, from an operational position where the crawler assemblies 162 and 164 are aligned with each other, as shown in FIGS. 3 and 7A–B. Of course, the female receiving member and the male attachment device may be interchanged without departing from the spirit of the invention. In other embodiments, the opening 226 may be circular or a plurality of pins 232 and openings 226 may be used to attach the crawler assemblies.

The attachment of the front and rear crawler assemblies 162 and 164 is similar to the carbody to crawler connection used with the M-250 Series crawler crane manufactured by Manitowoc Crane, Inc. of Manitowoc, Wis. and described in U.S. patent application Ser. No. 08/469,194, filed Jun. 6, 1995, whose contents are incorporated herein by reference. In particular, the rear end 224 of the front crawler assembly 162 is positioned above the front end 230 of the rear crawler assembly 164 such that the longitudinal axis 234 of the opening 226 is at an angle of between 0° and 45° or between 0° and 15°, preferably 5° to 15°, with respect to the longitudinal axis 236 of the vertical pin 232. Next, the front crawler assembly 162 is lowered so that the opening 226 engages the pin 232. The lowering of the front crawler assembly 162 is continued so as to allow rotary engagement of the front crawler assembly 162 into an operational alignment position with respect to the rear crawler assembly 164. At the operational position, the shoulder 231 engages the bearing surface 23. In addition, a stop and stop surface may be provided in the lower portions of the car assemblies in a manner similar to the stop and stop surface described in U.S. patent application Ser. No. 08/469,194 which engage one another at the operational position so as to align the apertures 233, 235 of the vertical plates 237 and 239 of the car assemblies 162 and 164, respectively. Once in the operational position, two pins 241 are inserted into the aligned apertures 233 and 235 so as to lock the crawler assemblies 162 and 164 to each other.

Figure 6B:
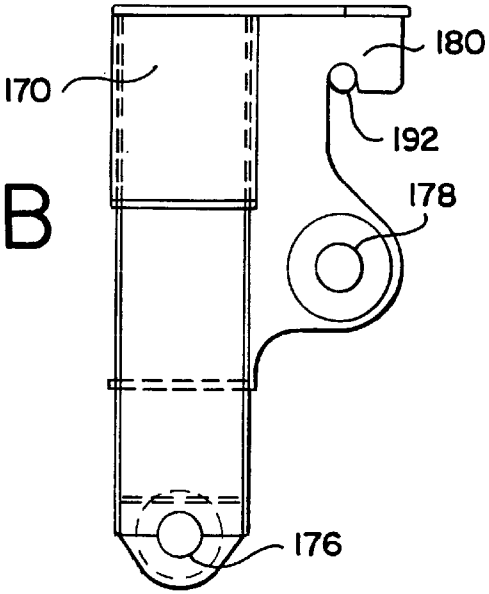
FIG. 6B shows a front view of a carbody to crawler assembly connector to be used with the connection of FIG. 6A.
Figure 6A:
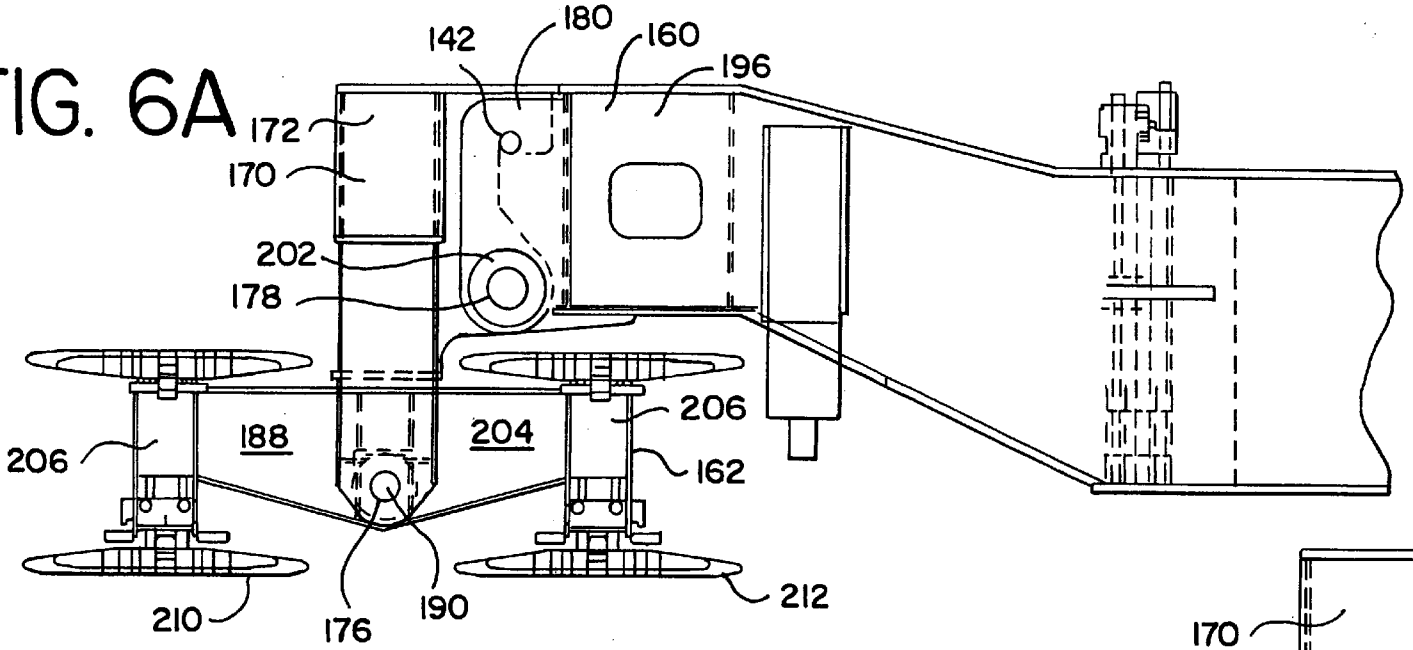
FIG. 6A shows a front view of the connection between the crawler assembly of FIGS. 4A–E and the carbody of FIGS. 5A–B.

With the crawler assemblies 162, 164 and 166, 168 attached to one another, the ends 160 of the parallel beams 150, 152 are attached to the four crawler assemblies. Attachment of the crawler assemblies 162, 164, 166 and 168 to each beam 150, 152 is accomplished in the same manner by an L-shaped connector 170 that has a front side 172 and a rear side 174 that have a pair of openings 176, 178 and a female receptor 180, as shown in FIG. 6B. Each connector 170 is made of a welded high strength steel plate and weighs approximately 3,000 lbs. In the case of the left, front crawler assembly 162, the connector 170 is first attached to the crawler assembly 162 by aligning the lower openings 176 with corresponding openings 182 formed in the front and rear faces 184 and 186 of the crawler assembly frame 188. A pair of pins 190 are then inserted into the aligned openings 176 and 182. Besides attaching the crawler assembly frame 188 to the connector 170, the pins 190 allow the crawler assembly 162 to pivot about the longitudinal axis centered on the aligned openings 176 and 182. After attaching the connector 170 to the crawler assembly frame 188, the connector 170 and attached crawler assembly frame 188 are lifted by a crane and lowered so as to engage the carbody 110. As shown in FIG. 6A, each end 160 has a pin 192 that is attached to the front and rear sides 196, 198, respectively, of the beams 150, 152. Upon lowering by the crane, the female receptor 180 are hooked over and engage with the pin 192. Next, the connector 170 and crawler assembly 162 are further lowered so as to pivot about the pin 192 downward to the position shown in FIG. 6A. The connector 170 and crawler assembly 162 are further secured to the carbody 110 by a horizontal pin 202 that extends through the upper openings 178 formed in the sides 172 and 174 of the connector 170. Further stability is accomplished by attaching four tubular structures 400 to the crawler assembly frames 188 and the beams 150 and 152.

Figure 4B:
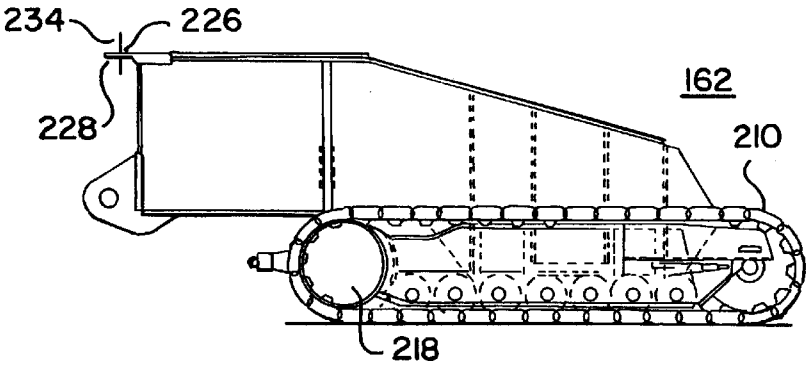
FIG. 4B shows a left side view of the crawler assembly of FIG. 4B.
Figure 4A:
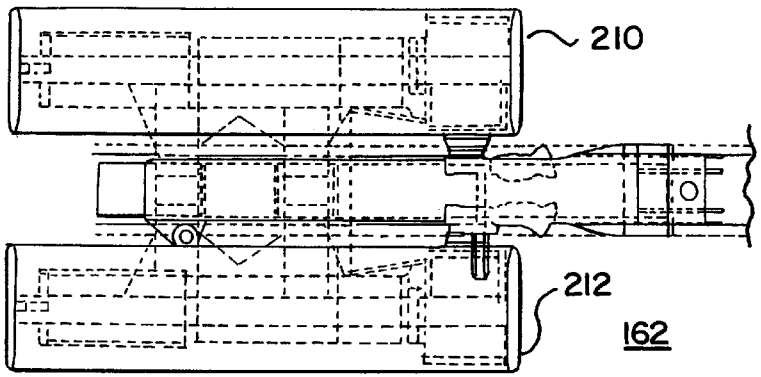
FIG. 4A shows a top view of a crawler assembly to be used with the crawler cranes of FIGS. 1–3 and 13–14.
Figure 5A:
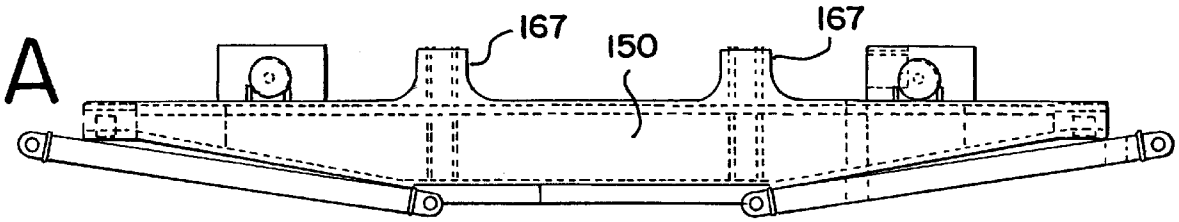
FIG. 5A shows a top view of a beam of a carbody to be used with the crawler cranes of FIGS. 1–3 and 13–14.
Figure 5B:
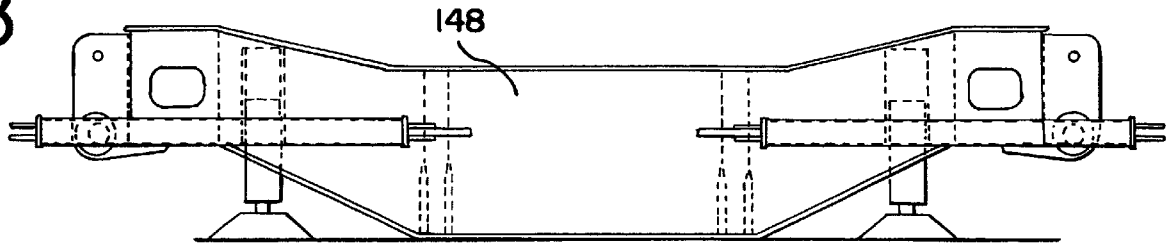
FIG. 5B shows a side view of the carbody to be used with the crawler cranes of FIGS. 1–3 and 13–14.
Figure 4C:
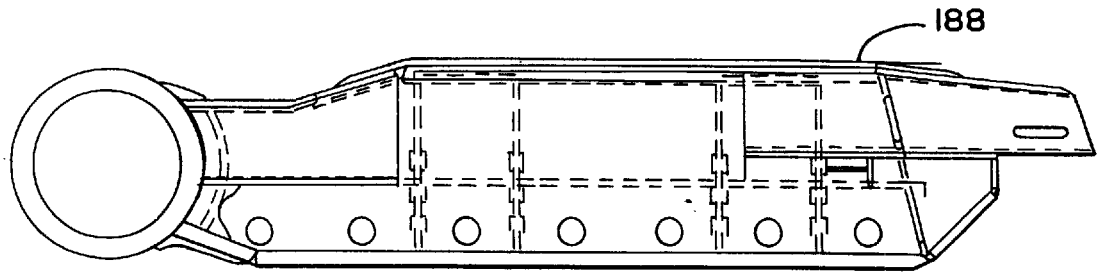
FIG. 4C shows a right side view of a crawler frame to be used with the crawler assembly of FIGS. 4A–B.
Figure 4D:
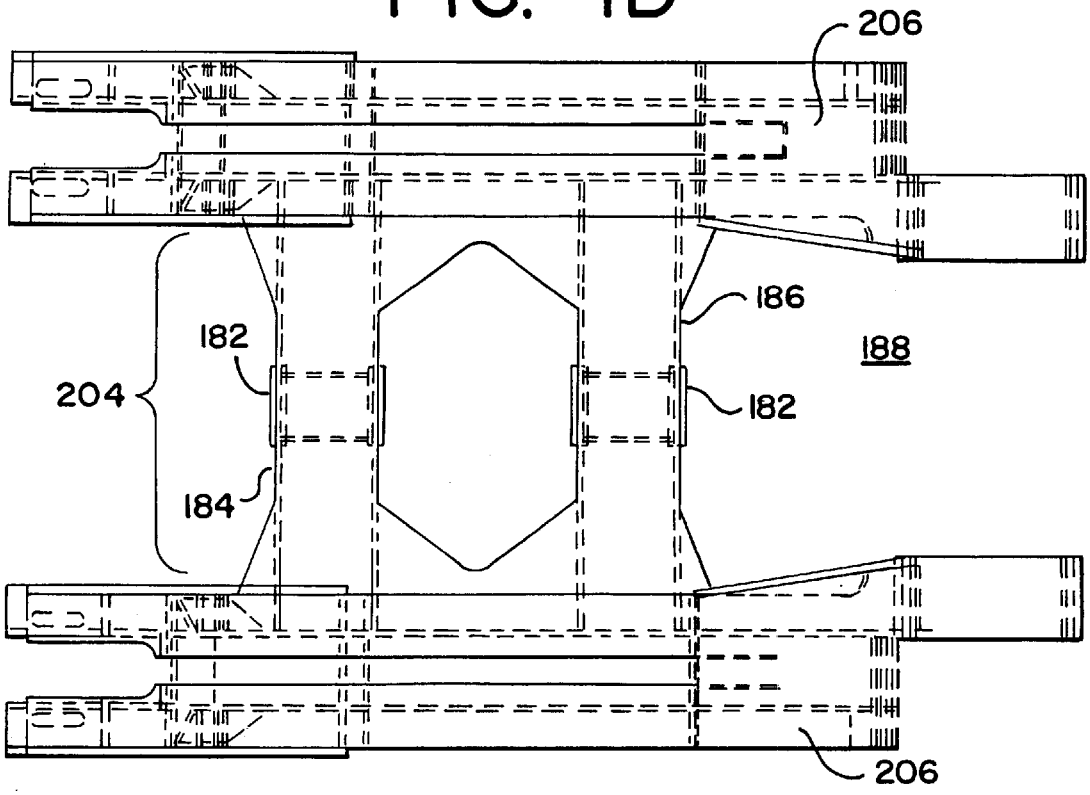
FIG. 4D shows a top view of the crawler frame of FIG. 4C.
Figure 4E:
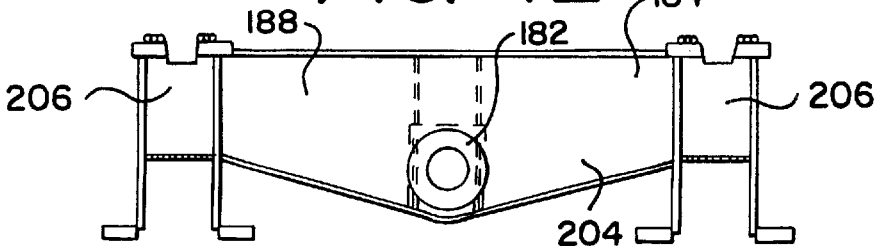
FIG. 4E shows a front view of the crawler frame of FIG. 4C.

As shown in FIG. 4D, each crawler assembly frame 188 is composed of a central frame 204 that is integrally attached to a pair of crawler frames 206 that are parallel to one another and spaced from each other by approximately 90.5 inches. The central frame 204 has a length of approximately 72 inches and a width of approximately 66 inches. Each of the crawler frames 206 have a length of approximately 180 inches, a width of approximately 40 inches and a height of approximately 33 inches. The crawler frames 206 and the central frame are each made of a welded high strength steel plate so that each crawler frame 206 has a weight of approximately 6 tons and the central frame 204 has a weight of approximately 2.5 tons. Each crawler frame 206 supports an outer loop-like crawler track 210 and an inner loop-like crawler track 212 that have a width of approximately 1.22 m and a length of approximately 5.06 m. The outer and inner track widths may be 1.52 m as well. The outer and inner tracks 210 and 212 are separated from one another by a distance of approximately 90.5". Thus, each crawler assembly 162, 164, 166, 168 is composed of an outer crawler track 210 and an inner crawler track 212 that are parallel to each other and are located on opposing lateral sides 214, 216 of the central frame 204.

Though the discussion to follow regards the structure to move the pair of crawler tracks 210, 212 associated with a single crawler assembly 162, it is equally applicable to the other three crawler assemblies 164, 166 and 168. As shown in FIGS. 4A–B, each crawler frame 206 of the crawler assembly 162 has a tumbler 218 at the inner end that engages and moves the crawler tracks 210, 212 associated with the crawler frame 206 in a well known manner. The tumbler 218 associated with each crawler frame 206 is driven by a hydraulic motor and gear reduction in a well known manner. Thus, the outer crawler track 210 is powered by at least one motor and gear reduction 220 and the inner crawler track 212 is powered by at least one motor and gear reduction 222 as shown in FIG. 3. The motors 220 and 222 associated with each crawler frame 206 are controlled by an operator in the operator's cab 106 in a well known manner. In order for the dual track crawler assembly 162 to act in the same manner as a single track crawler assembly, the motors 220 and 222 are synchronized so that each of the crawler tracks 210 and 212 of the crawler assembly 162 move in unison. Synchronization is achieved by having the motors 220 and 222 share a common pump that supplies the hydraulic fluid to the motors.

As shown in FIG. 3, the left, front and right, front crawler assemblies 162 and 166 attached to the front beam 150 are aligned with the direction of travel of the left, rear and right, rear crawler assemblies 164 and 168, respectively, attached to the rear beam 152. On the left side (L) of the carbody 110, the outer crawler track 210 of the left, front crawler assembly 162 is aligned with the direction of travel of the outer crawler track 210 of the left, rear crawler assembly 164. The inner crawler track 212 of the crawler assembly 162 is aligned with the direction of travel of the inner crawler track 212 of the crawler assembly 164. Similarly, the inner and outer crawler tracks 210 and 212 of the front crawler assembly 166 located on the right side R of the carbody 110 are aligned with the direction of travel of the inner and outer crawler tracks 210 and 212, respectively, of the rear crawler assembly 168. It is desired that the aligned front and rear crawler assemblies 162 and 164 on the left side of the carbody 110 act as a single left crawler track and the aligned crawler assemblies 166 and 168 on the right side of the carbody 110 act as a single right crawler track. This is accomplished by synchronizing the motors 220 and 222 of the left, front crawler assembly 162 with the motors 220 and 222 of the left, rear crawler assembly 164 so that all four crawler tracks on the left side of the carbody 110 move in unison. Synchronization is accomplished by an electronic control unit located in superstructure 105 that is electrically connected to the common pumps of the crawler assemblies 162 and 164 so as to control the pumping of hydraulic fluid by the pumps. Similarly, the motors 220 and 222 of the right, front crawler assembly 166 are synchronized with the motors 220 and 222 of the right, rear crawler assembly 168 so that the four crawler tracks on the right side of the carbody 110 move in unison. The net effect of this arrangement is that the crawler crane 100 can be thought of having a single left crawler track and a single right crawler track, each crawler track having a footprint width, W, equal to approximately 11 feet 5 inches, the width of the dual track crawler assembly, and an effective footprint length equal the distance from the furthest ends of the aligned crawler assemblies while not making contact with the ground by a distance, d, that is approximately 11 feet. The gap d lessens the effective footprint length to approximately 33 feet.

Figure 11A:
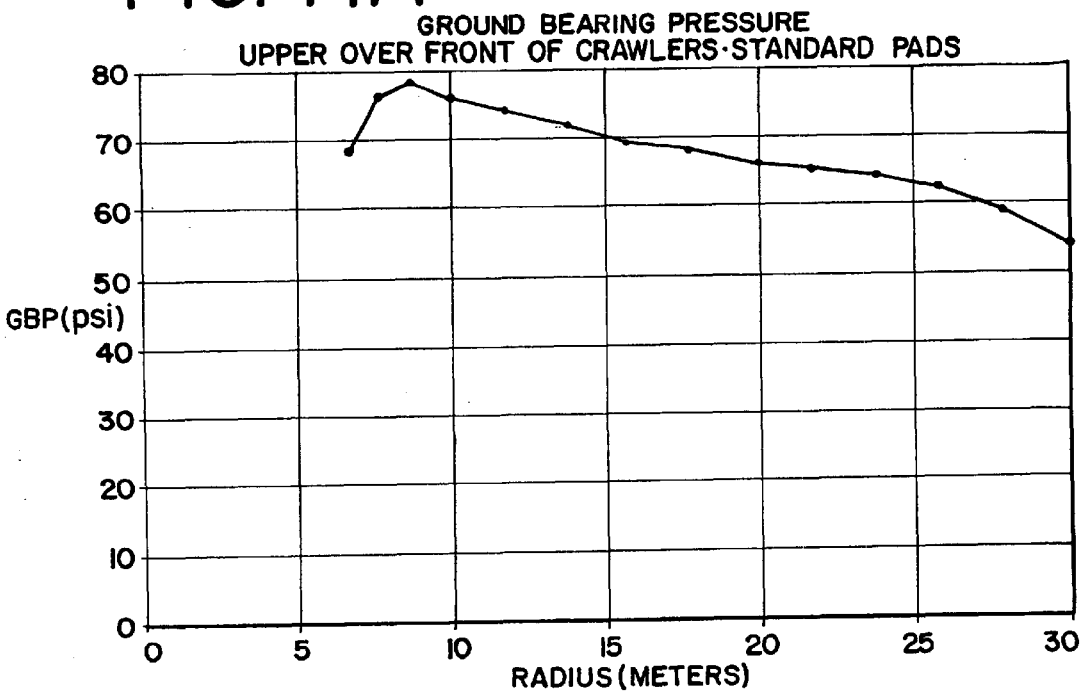
FIG. 11A shows a ground bearing pressure over the front of the crawler vs. load radius graph for 1.2 m wide crawler track.
Figure 11B:
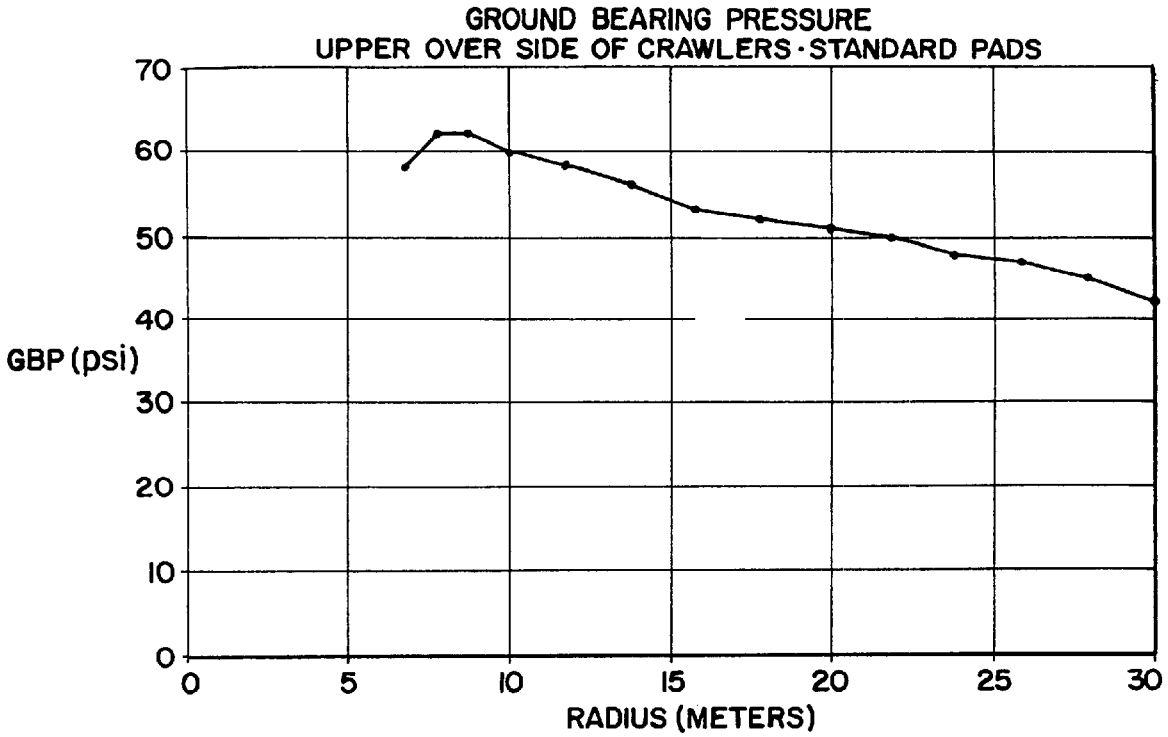
FIG. 11B shows a ground bearing pressure over the side of the crawler vs. load radius graph for 1.2 m wide crawler track.
Figure 11C:
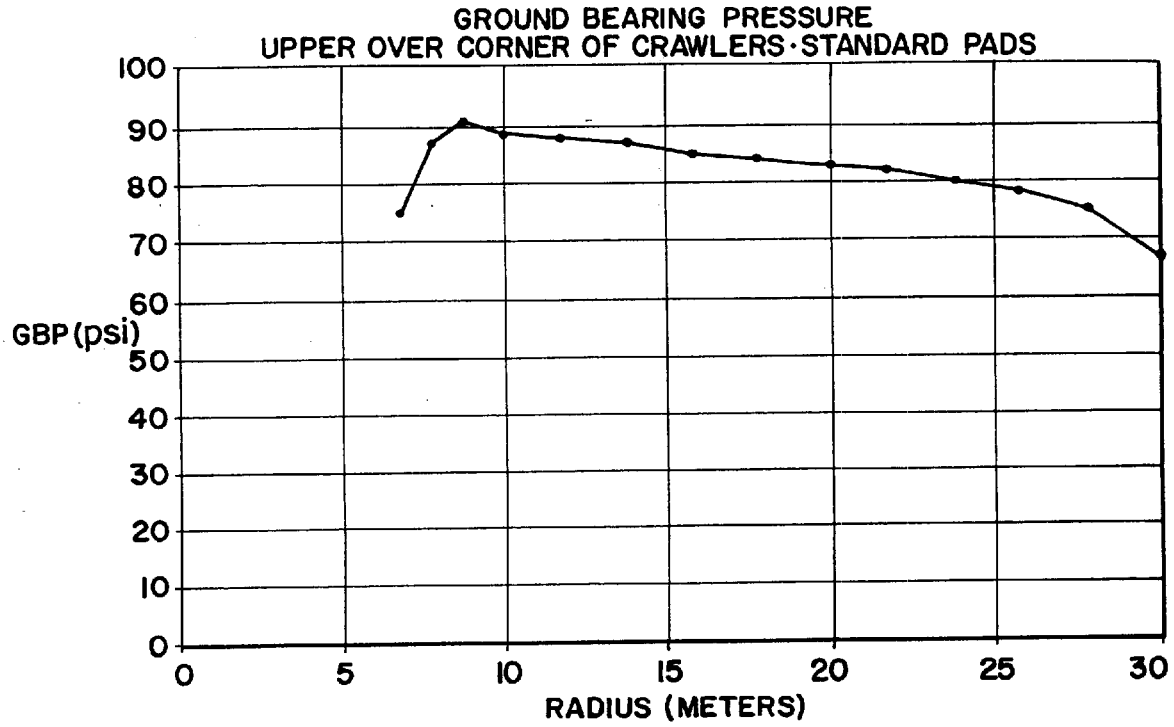
FIG. 11C shows a ground bearing pressure over the corner of the crawler vs. load radius graph for 1.2 m wide crawler track.
Figure 12A:
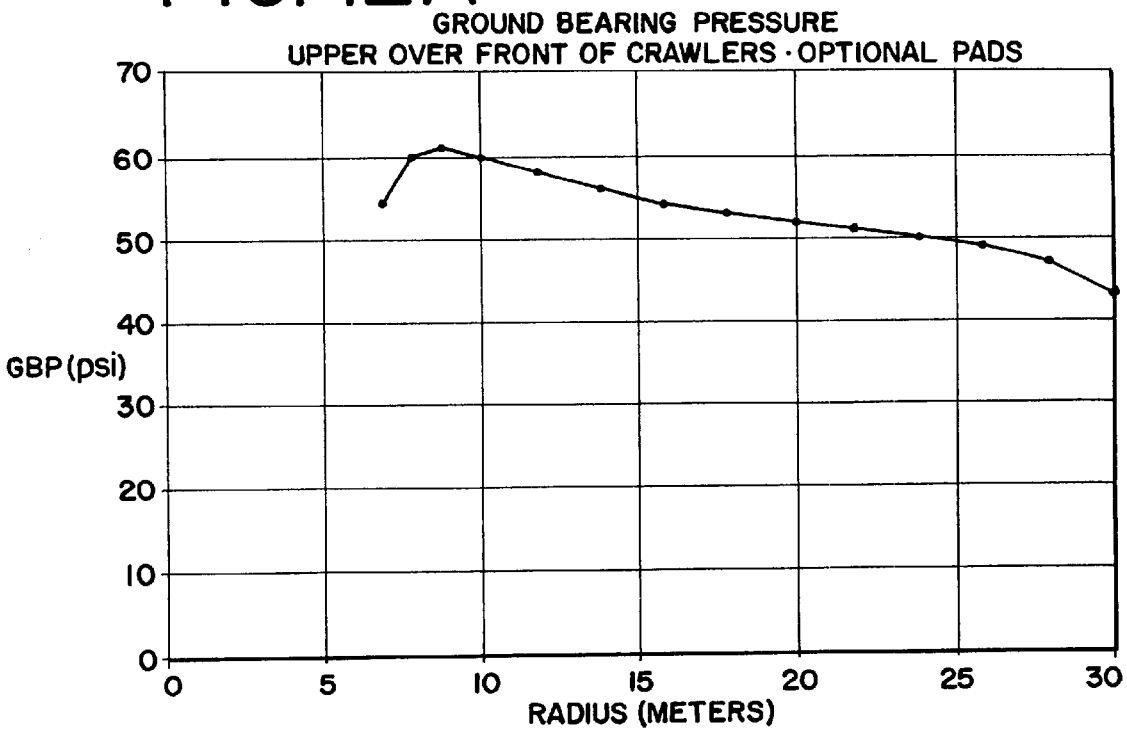
FIG. 12A shows a ground bearing pressure over the front of the crawler vs. toad radius graph for 1.5 m wide crawler track.
Figure 12B:
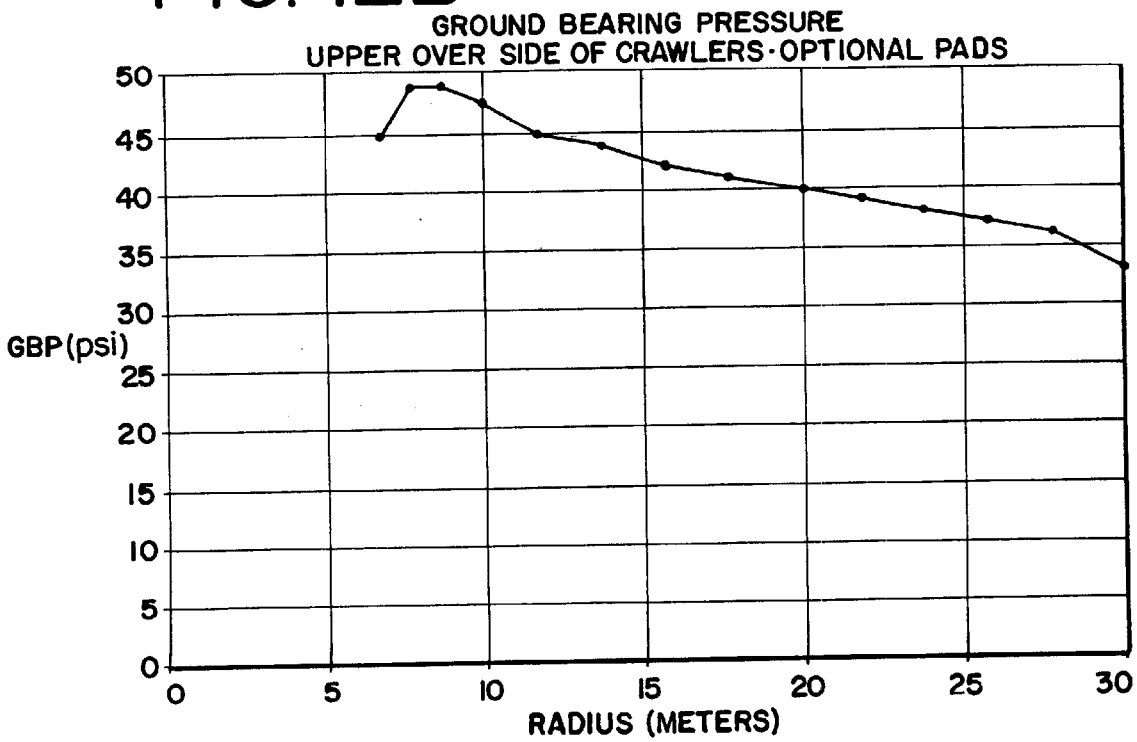
FIG. 12B shows a ground bearing pressure over the side of the crawler vs. load radius graph for 1.5 m wide crawler track.
Figure 12C:
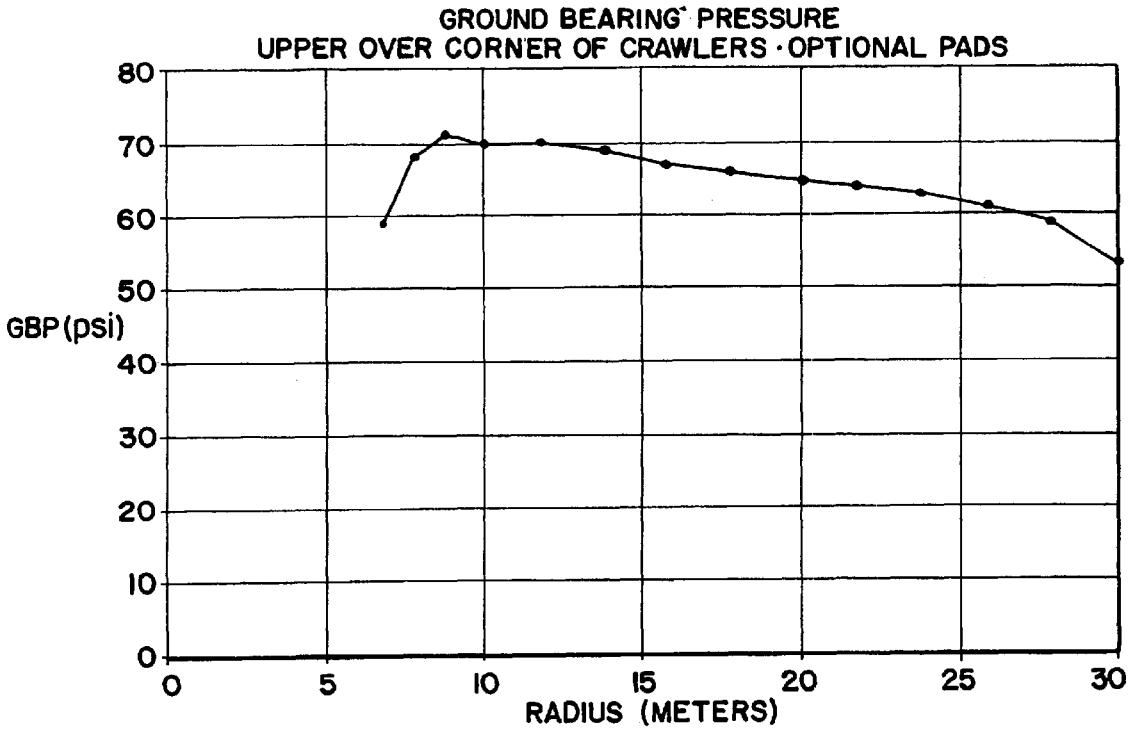
FIG. 12C shows a ground bearing pressure over the corner of the crawler vs. load radius graph for 1.5 m wide crawler track.

Not being limited to the following explanation, it is believed that the increased footprint width and/or the reduced footprint length lessens ground bearing pressures at the front, rear, sides and corners of the crawler tracks 210. The reduction in ground bearing pressure is especially noticeable at the front and corners of the crawlers which leads to improved turning by the crawler crane 100. For example, when tracks 210 having a width of 1.22 m are used, the ground bearing pressures for loads ranging in radii from 7 to 30 m are in the ranges of: (1) between 80 and 58 psi (pounds per square inch) at the front and rear of the crawler, (2) between approximately 60 and 40 psi at the sides of the crawler and (3) between approximately 90 and 70 psi (see FIGS. 11A–C). When tracks 210 having a width of 1.5 m are used, the ground bearing pressures for loads ranging in radii from 7 to 30 m are in the ranges of: (1) between approximately 60 and 40 psi at the front and rear of the crawler, (2) between approximately 50 and 30 psi at the sides of the crawler and (3) between approximately 70 and 50 psi (see FIGS. 12A–C).

Figure 8D:
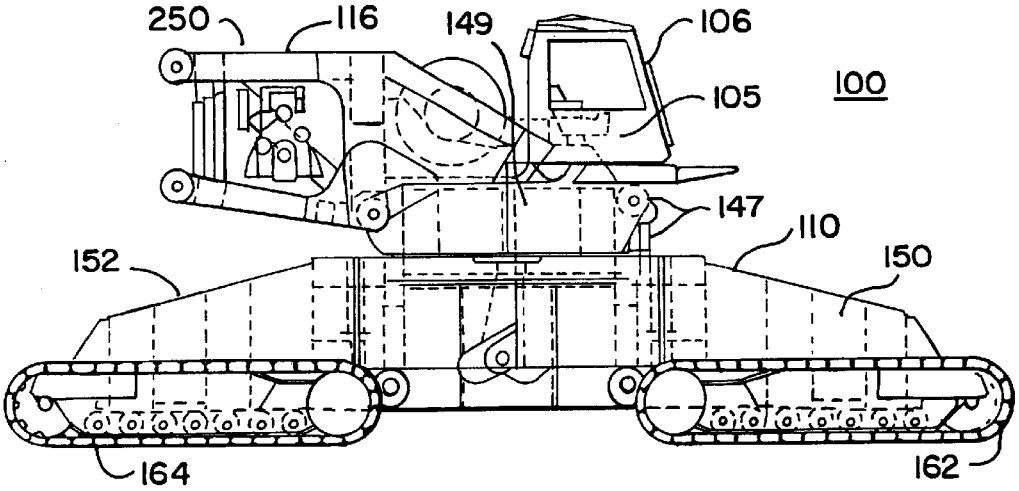
Figure 8E:
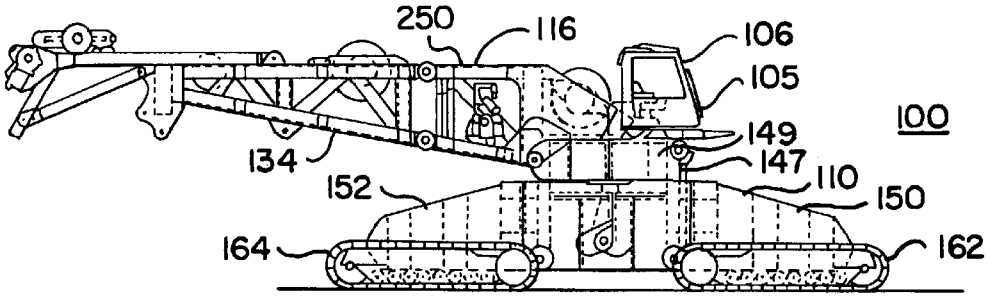
Figure 8F:
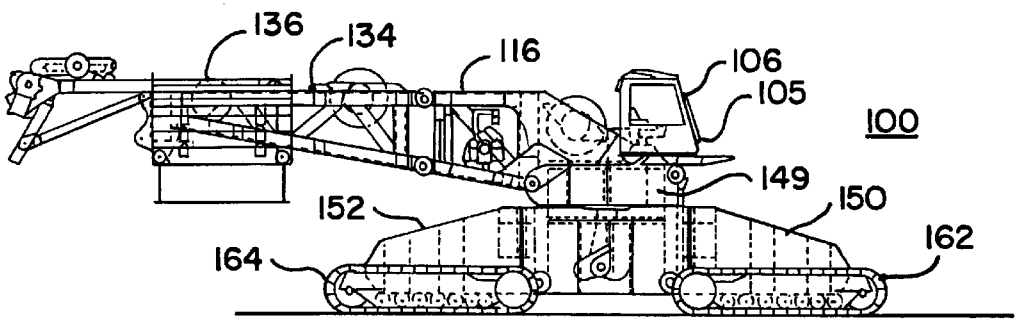

The above description describes how the crawler assemblies are attached to the carbody and themselves. The description to follow will give a flavor of the transporting and construction of the crawler crane of FIG. 1. In particular, a 43 ton central support structure 148, slewing bearing 147 and adapter frame 149 (FIG. 8A) are transported on a trailer bed to a work site. While the central support structure 148 rests on the trailer bed at the work site, the beams 150 and 152 that were transported on a trailer bed to the work site are attached to the central support structure 148 in the manner described previously to form the H-shaped carbody 110 of FIGS. 3 and 8B. Once the beams 150 and 152 are attached, hydraulic lifts 151 are activated and engage the ground so as to raise the assembled carbody 110 so that the trailer bed can be removed from underneath the carbody 110. Next, four crawler assemblies 162, 164, 166 and 168 are delivered on separate trailer beds to the work site where they are unloaded and attached to the carbody 110 and themselves in the manner described previously (see FIGS. 6, 7 and 8C). The front section 250 of the rotating bed 116 and the operator's cab 106 are transported on a trailer bed to the work site where they are attached to the adapter frame 149 in a well known manner as shown in FIG. 8D. Next, the rear part 134 of the rotating bed 116 and the counterweight 136 are delivered to the work site on separate trailer beds and then are attached to the front section 250 of the rotating bed 116 in a well known manner (FIGS. 8E–F).

Figure 8G:
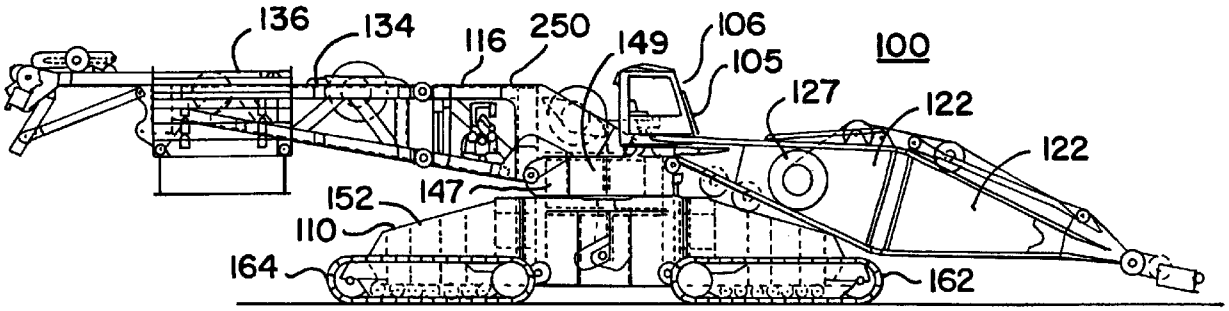
Figure 8H:
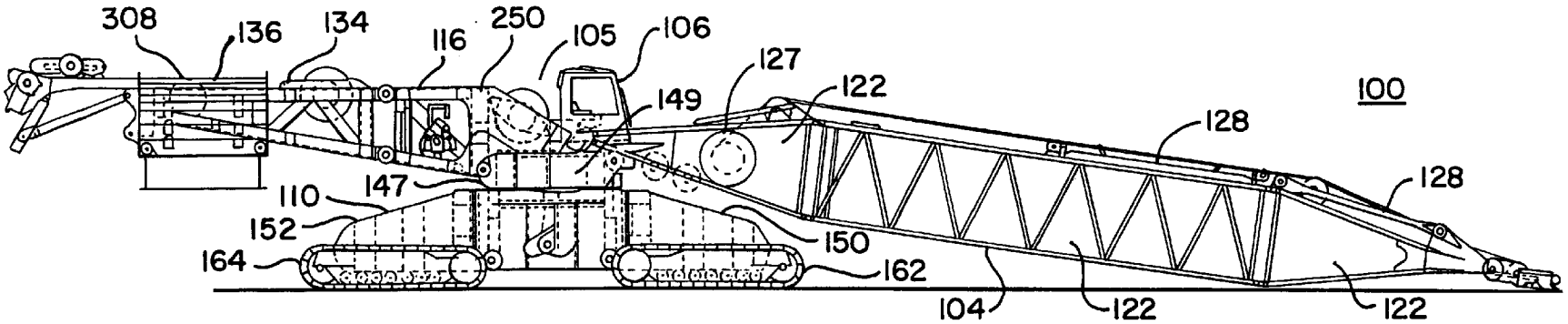
Figure 9A:
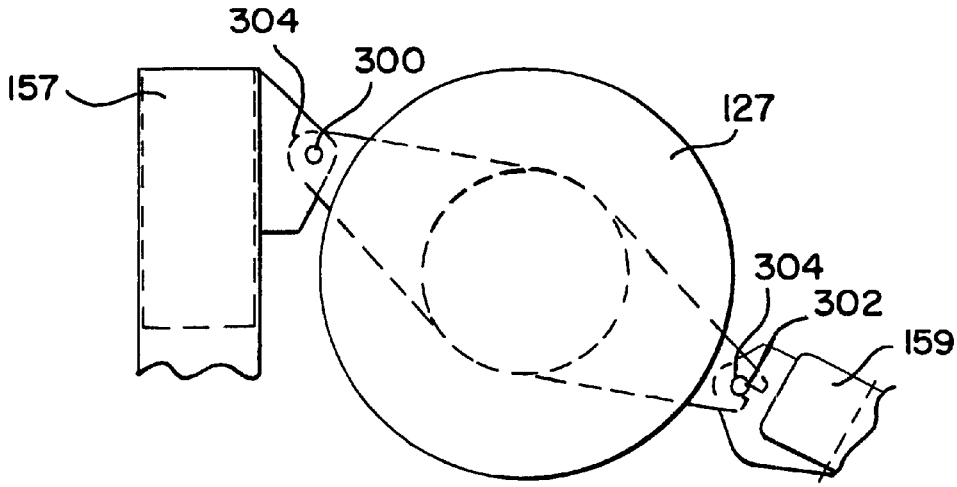
FIG. 9A shows a side view of a hoist drum support to be used with the crawler cranes of FIGS. 1–2 and 13–14.
Figure 9B:
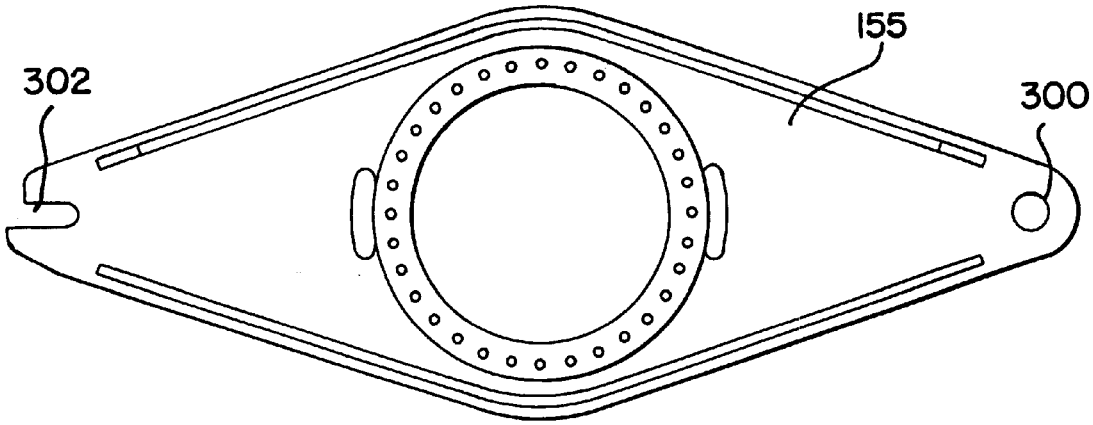
FIG. 9B shows a front view of a support plate to be used with the support of FIG. 9A.

Once the rotating bed 116 and counterweight 136 are in place, the crane boom 102 and the mast 104 can be attached. The top and bottom frames 122 of the mast 104, the boom hoist drum 127 and the equalizer are transported on one trailer bed and the middle frame 122 of the mast 104 is transported on a separate trailer bed. As shown in FIG. 8G, the top and bottom frames 122 of the mast 104 are attached to one another. In addition, the boom hoist drum 127 is rotatably attached within the bottom frame of the mast 104 by having a support plate 155 that is attached to a pair of brackets 157, 159 that are attached to the bottom frame as schematically shown in FIGS. 9A–B. The support plate 155 has a closed opening 300 and a slot 302 that engage pins 304 attached to the brackets 157 and 159. Positioning the boom hoist drum 127 within the bottom frame 122 provides a significant advantage in assembling and disassembling the crawler crane 100. In particular, the second wire rope system 126 is maintained on the top and bottom frames 122 throughout the assembly, transport and disassembly of the crawler crane 100 while other crawler cranes require the wire rope system to be taken down during disassembly.

Figure 8I:
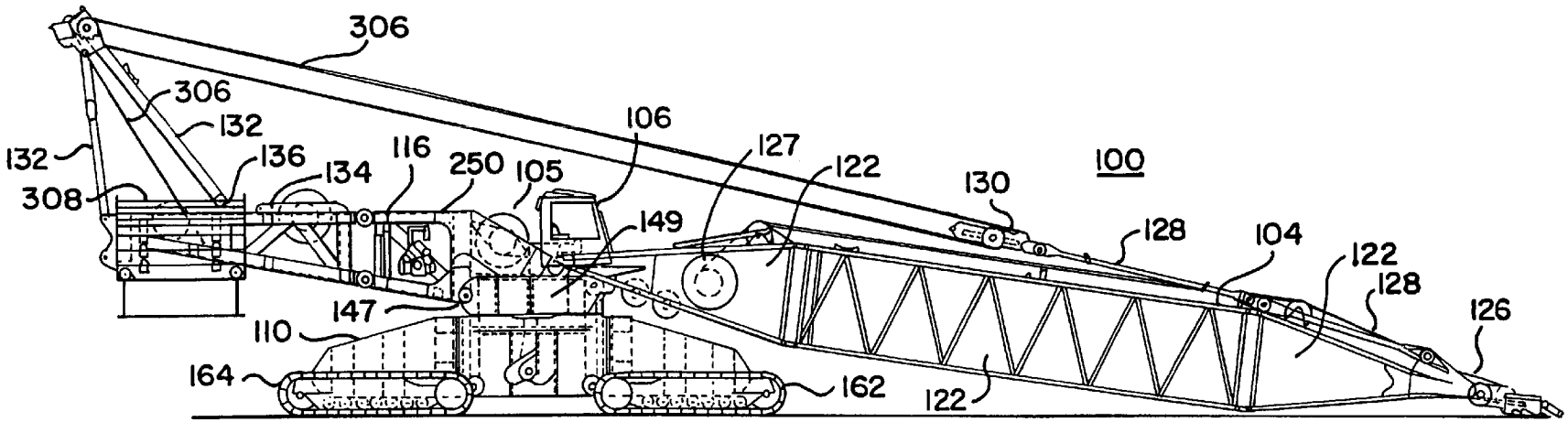

As shown in FIG. 8G, the top and bottom frames 122 are attached to the adapter frame 149 in a well known manner. The top and bottom frames 122 are separated from one another so that the middle frame 122 is placed between and attached to the top and bottom masts 122 (see FIG. 8H). As shown in FIG. 8I, the wire rope system 306 is pulled from the hoist drum 308 and connected to the equalizer 130. The hoist drum 308 is then rotated so as to hoist the mast 104 upwards (see FIG. 8J).

Figure 8J:
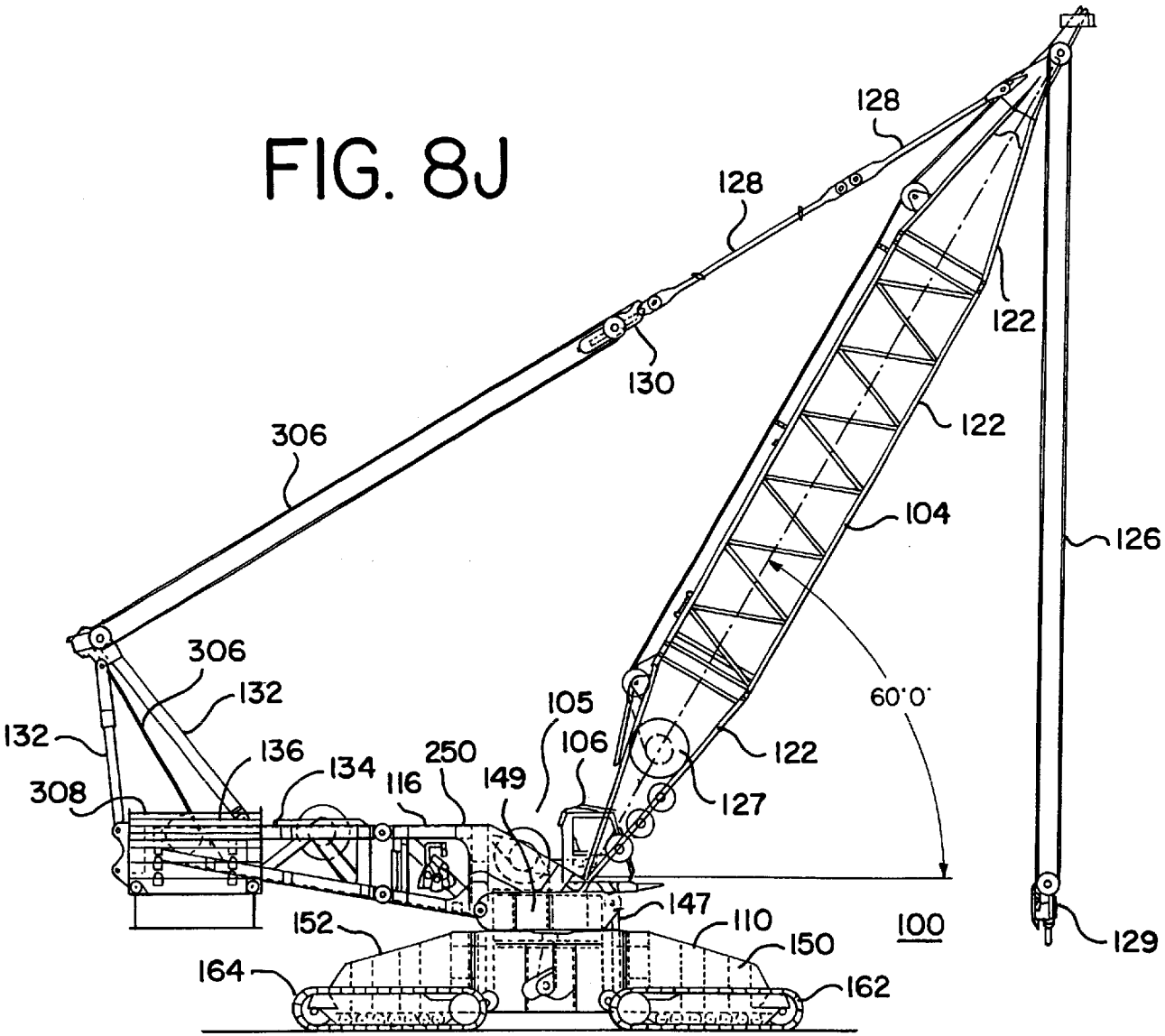
Figure 8K:
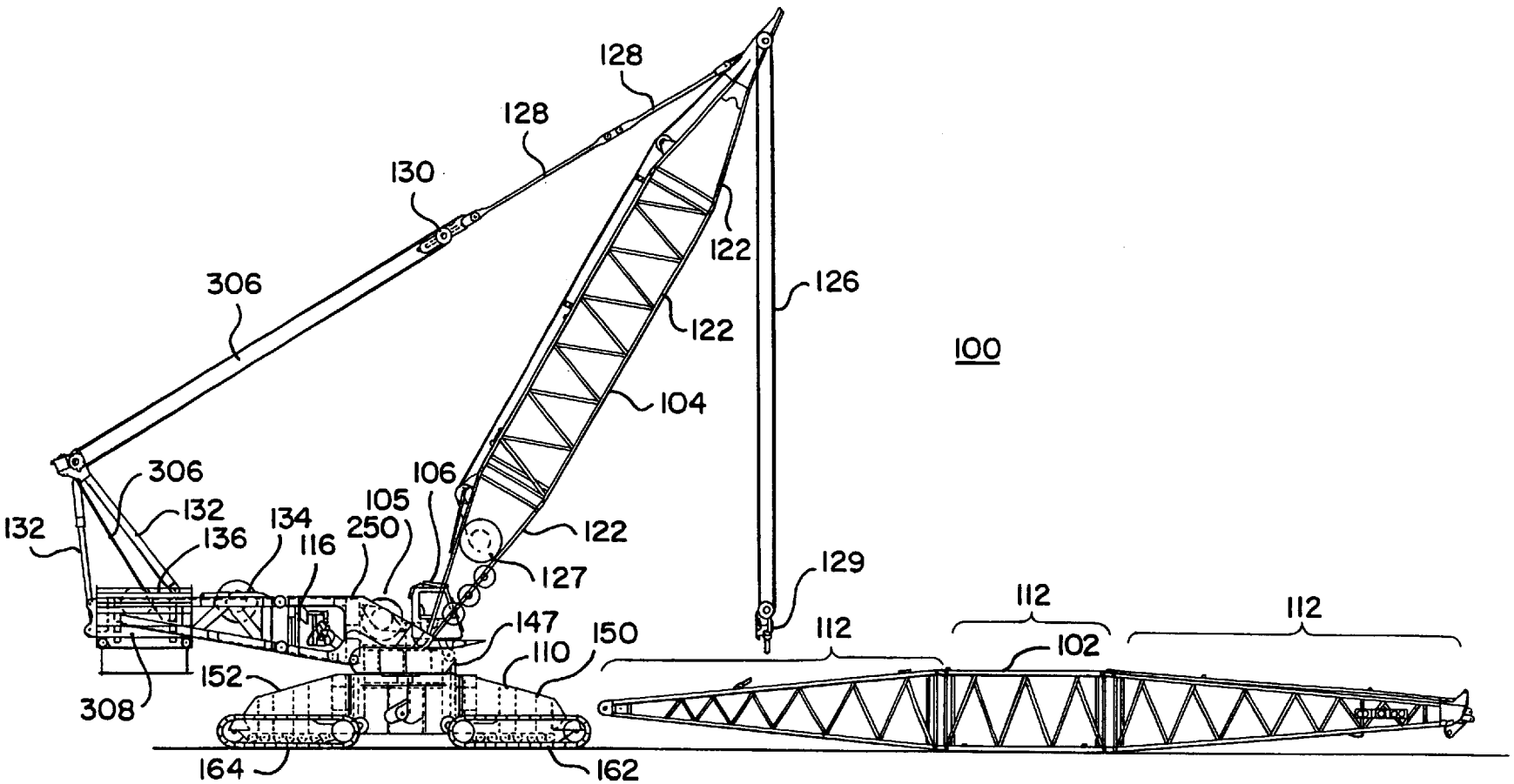
Figure 8L:
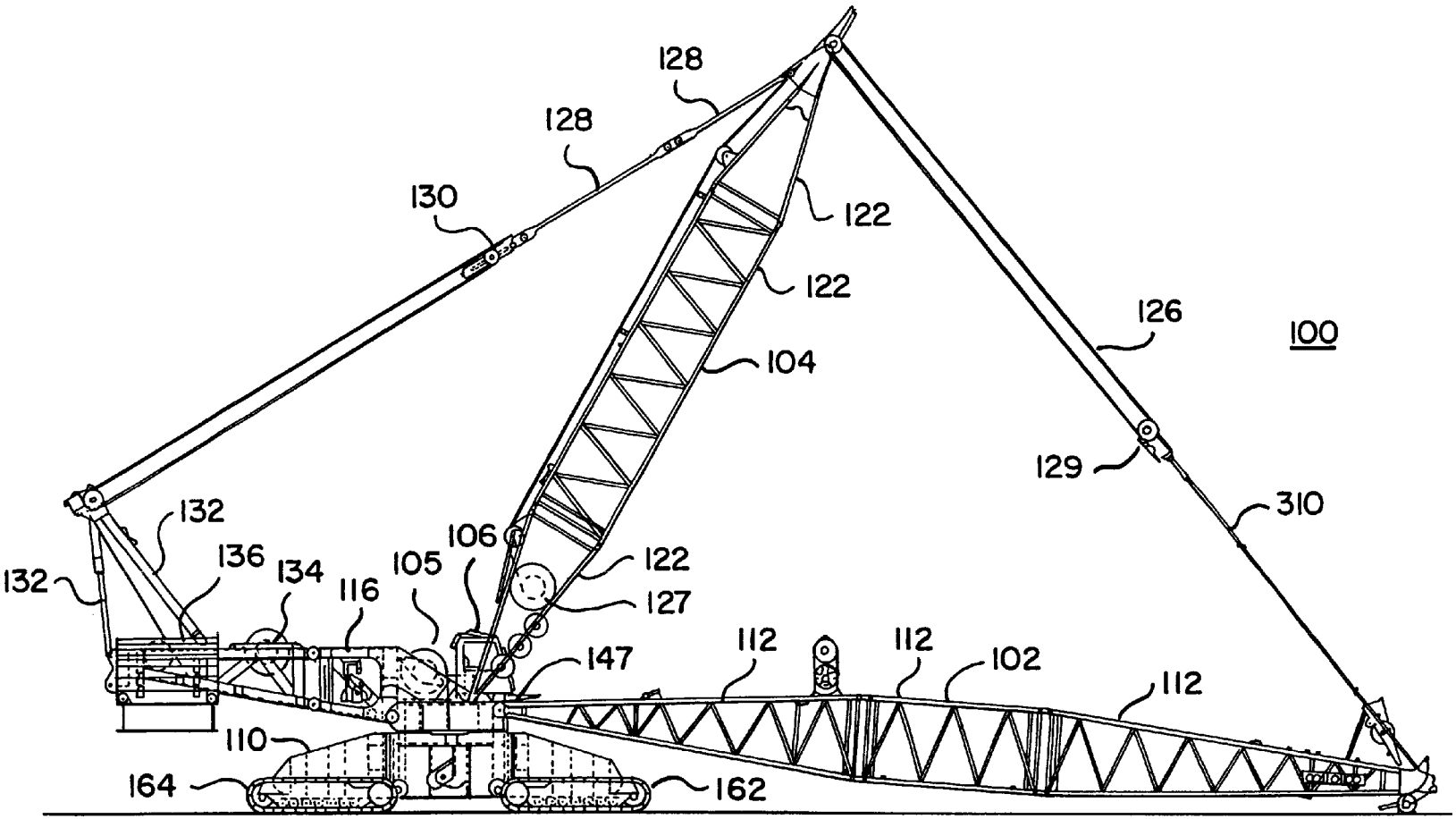
Figure 8M:
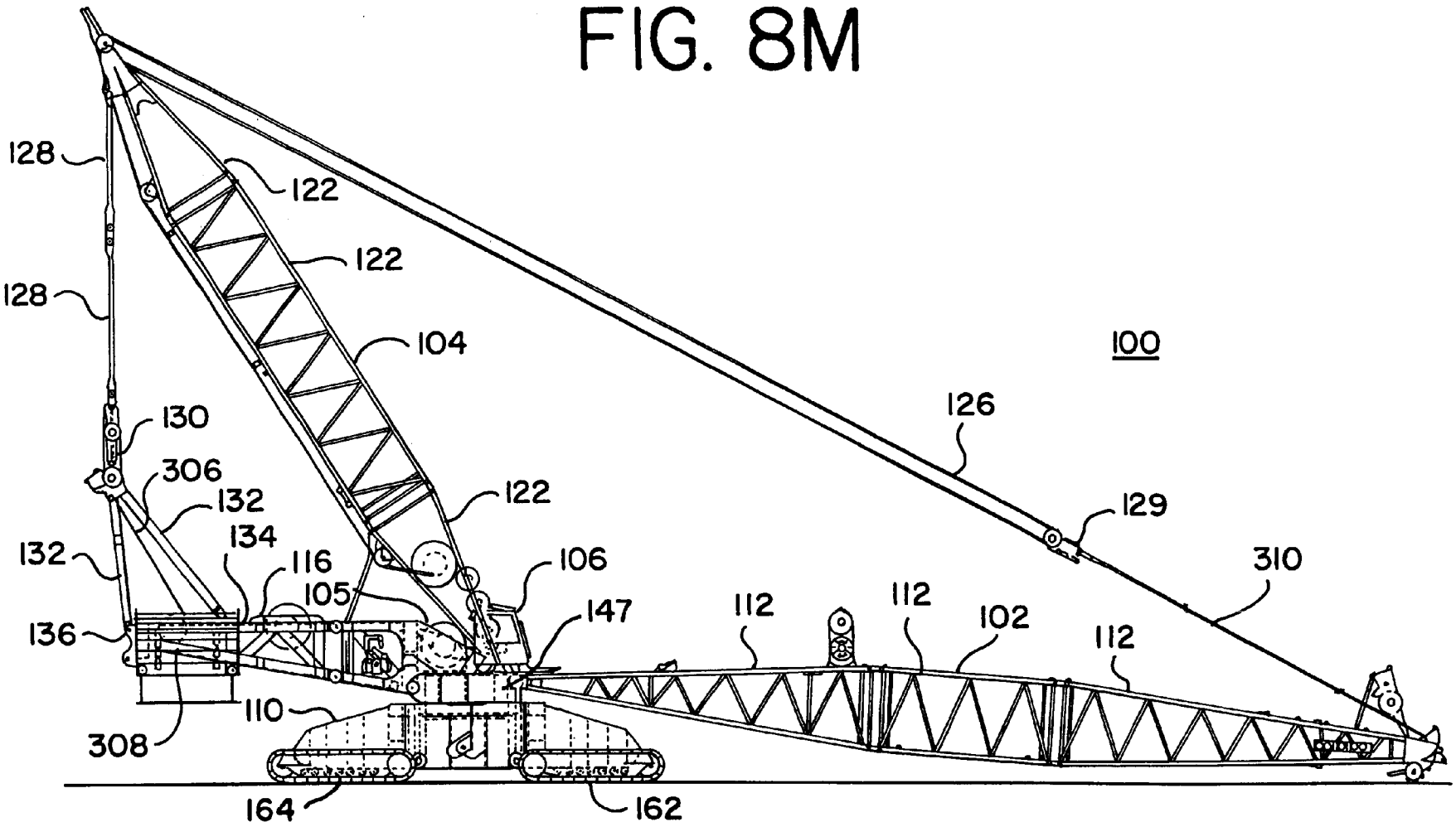

The completed mast 104 of FIG. 8J is used to hoist and support the crane boom 102 on the crawler crane 100. As shown in FIG. 8K, the three frames 112 of the crane boom 102 are attached to one another in a well known manner adjacent to the crawler crane 100. The three frames 112 are transported to the work site on separate trailer beds. The second operator's wire rope system 126 is arranged to have the equalizer 129 engage the bottom of the crane boom 102 while the top end of the crane boom 102 is lifted by an auxiliary crane. The crane boom 102 is then attached to the adapter frame 149 in a well known manner. The equalizer 129 is then disconnected from the crane boom 102 and the mast 104 is lowered until the equalizer 129 is positioned above the strap 310 that lies on the crane boom 102. At this stage the equalizer 129 is pinned to the strap 310 and the strap 310 is pulled tight (see FIG. 8L). Next, the hoist drum 308 is rotated so as to hoist the mast 104 to the working position of FIG. 8M where the hoist drum 127 is rotated so as to lift the crane boom 102 to an upright position (FIG. N). As shown in FIG. 80, the crawler crane 100 can be adapted to lift larger loads by extending the lengths of the mast 104 and the crane boom 102 by transporting sections 138 and 140 to the work site and adding a second counterweight 142 that is supported on the ground.

Figure 8O:
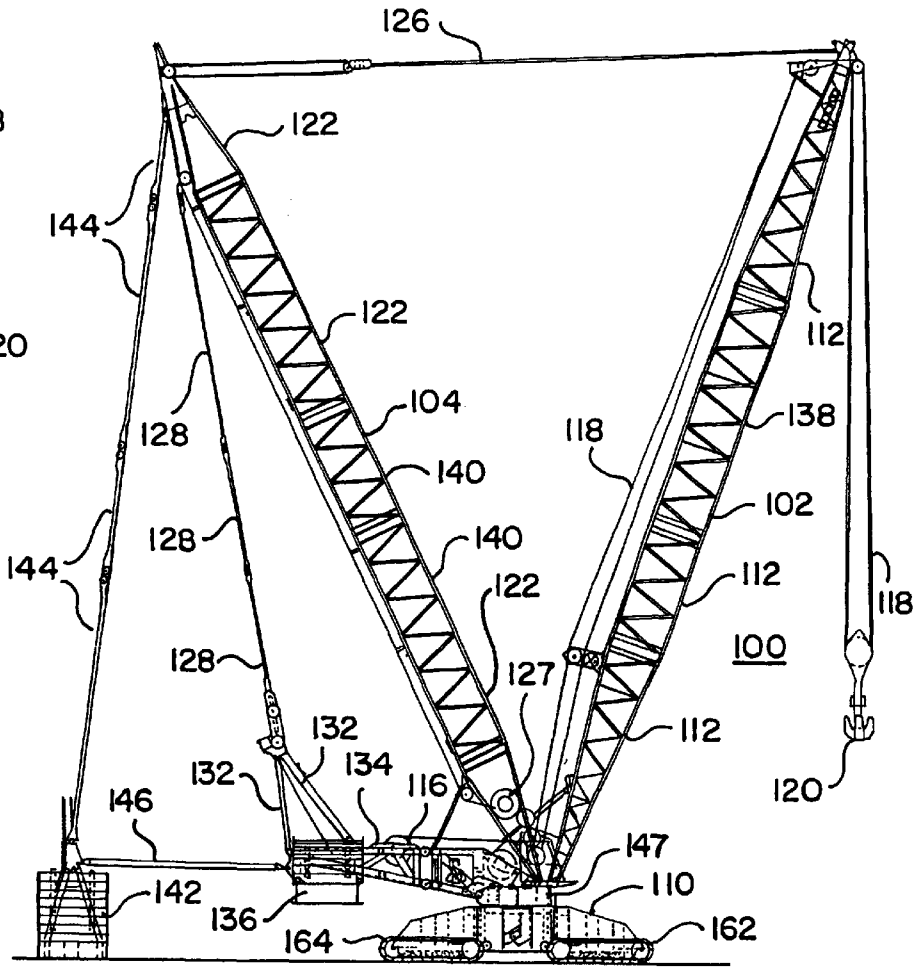
Figure 8N:
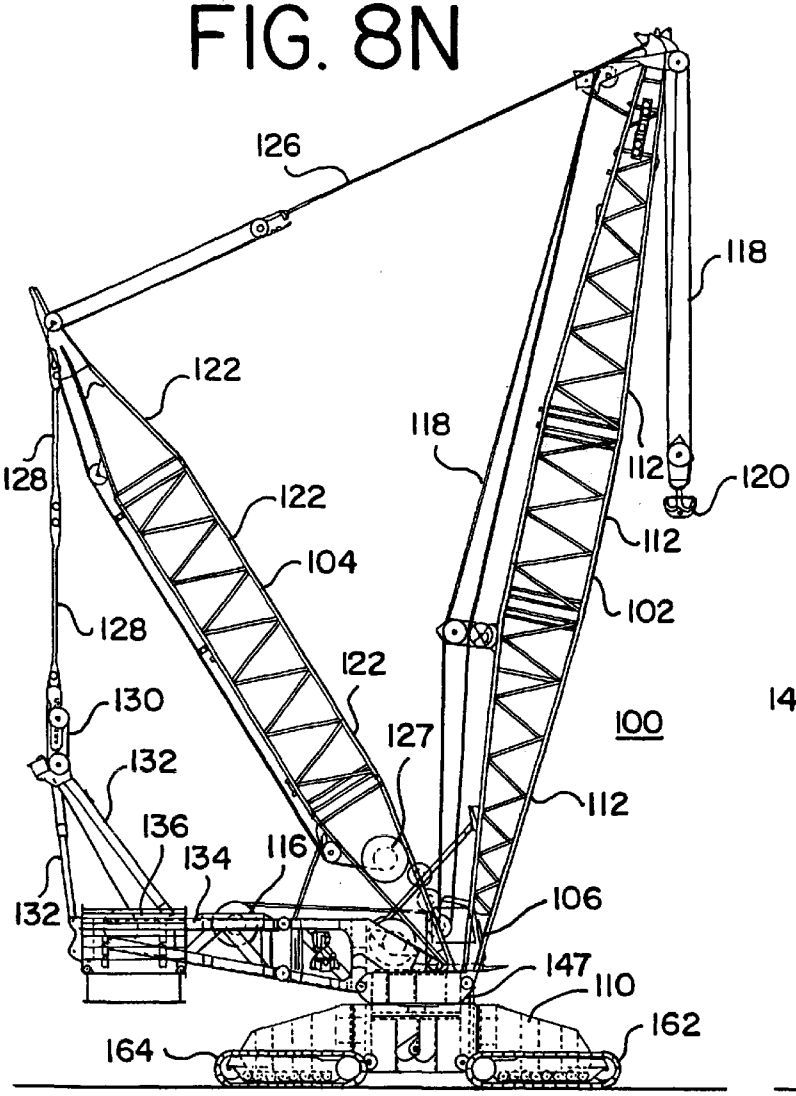

While the above description describes the assembly of the crawler cranes 100 of FIGS. 8N and 8O, it is understood that the disassembly of the crawler cranes 100 and transportation to another site would substantially entail the reversal of the assembly steps described above.

Note that other variations of the form of the carbody 110 are possible without departing from the spirit of the invention. For example, the overall width of attached carbody 110 and the crawler assemblies 162, 164, 166 and 168 can be reduced to about 30 feet by removing the beams 150 and 152 and attaching the crawler assemblies directly to the four attachment extensions or beams 159 of the central support structure 148 (see FIG. 13). Each crawler assembly 162, 164, 166, 168 has an attachment piece 312 that has a structure and function similar to the male insertion pieces 167 described previously that has a pair of pins and a lowering opening. Thus, the crawler assemblies are lowered onto the beams 159 so that their pins engage the hooks 163 and pivot downwards into an operational position where the crawler assemblies are locked in place by pins inserted into the lower openings. The net effect of this attachment is a narrower crawler crane 100 and the direction of movement of the crawler assemblies is parallel to the front and rear sides 156 and 158 of the central support structure 148. Note that triangular-like out riggers 314 can be attached to the assembled crawler assemblies so as to provide further stability. Note that in this embodiment all components of the crawler crane 100 and all assembling steps are the same as described previously for the crawler crane 100 of FIG. 1 unless specified otherwise above.

Figure 13:
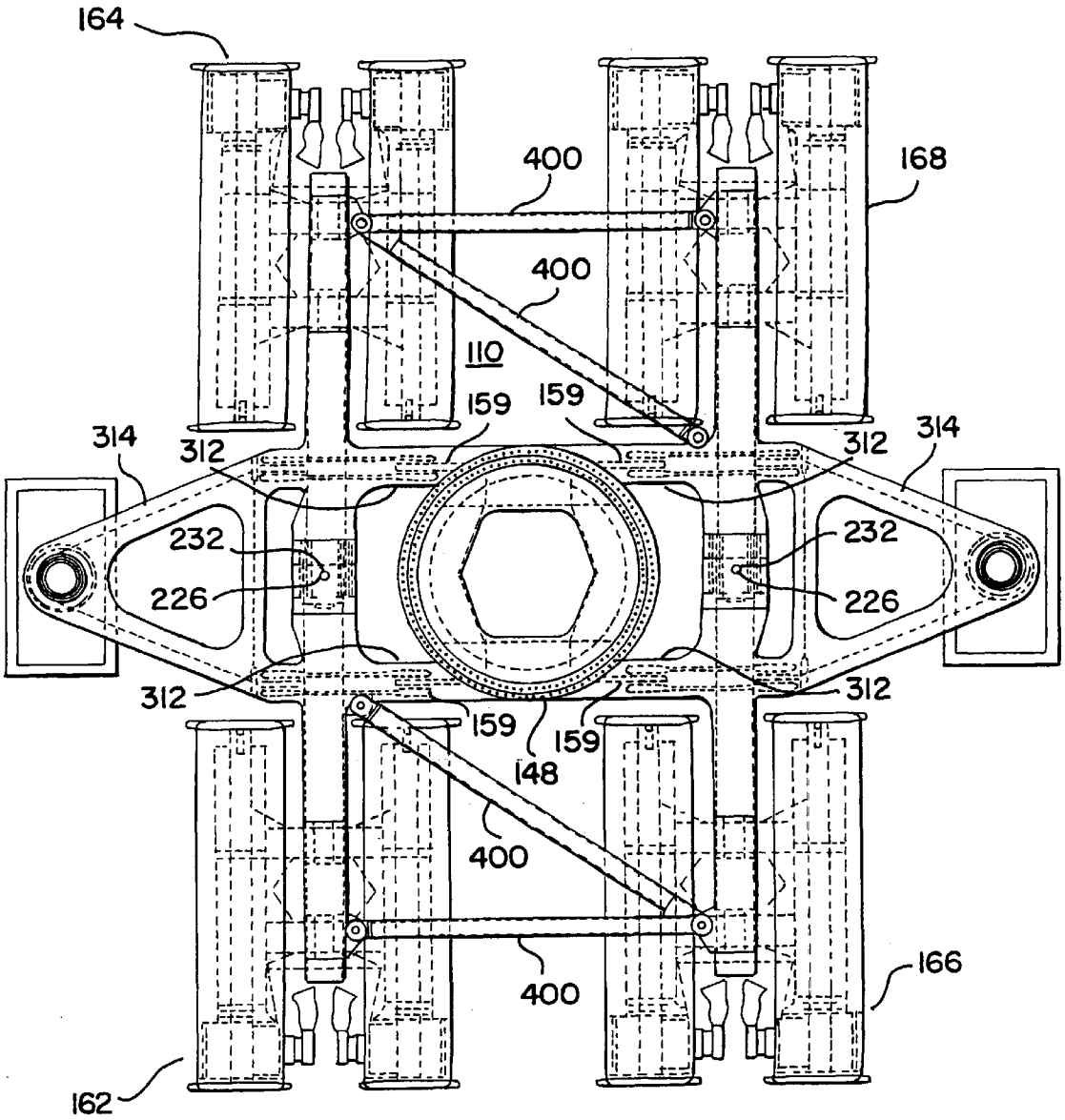
FIG. 13 shows a top view of a second embodiment of a carbody and crawler assembly system according to the present invention.
Figure 14:
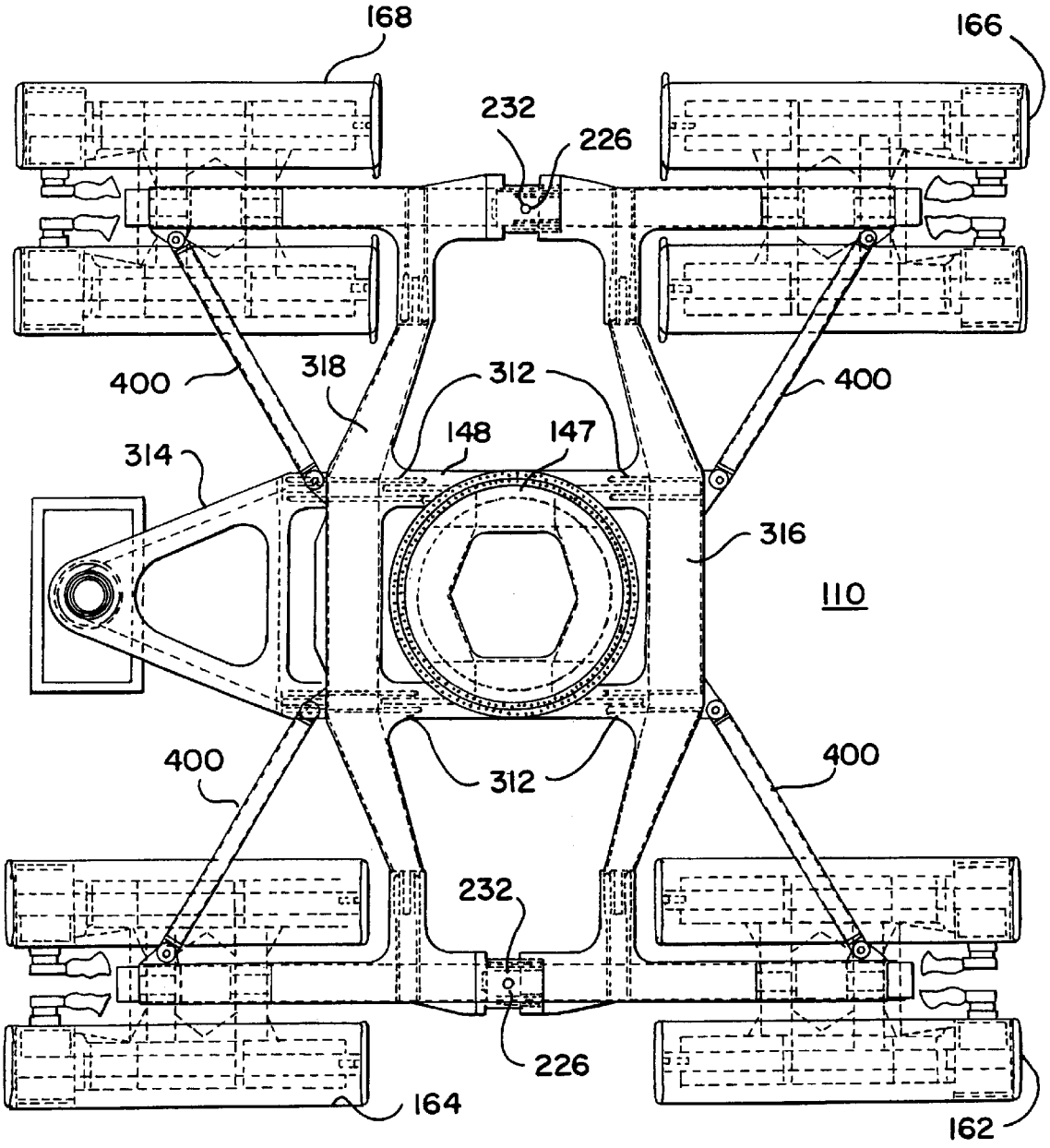
FIG. 14 shows a top view of a third embodiment of a carbody and crawler assembly system according to the present invention.

The embodiment of FIG. 13 can be transformed into a 47 foot wide crawler crane 100 by attaching beams 316 and 318 to the carbody. Beams 316 and 318 has the same attachment structure for attachment to the central support structure 148 as beams 150 and 152 for the embodiment of FIG. 1. The end of the beams 316 and 318 are adapted to face the attachment pieces 312 and the ends of the beams 316 and 318 have a hook-like structure similar to that of the ends of the beams 150 and 152. Accordingly, attachment of the assembled crawler assemblies to the beams 316 and 318 is similar to the attachment of the crawler assemblies and beams 150 and 152 of FIG. 1. Note that a triangular-like out riggers 314 can be attached to the assembled crawler assemblies so as to provide further stability. Note that in this embodiment all components of the crawler crane 100 and all assembling steps are the same as described previously for the crawler crane 100 of FIG. 1 unless specified otherwise above.

The foregoing description is provided to illustrate the invention, and is not to be construed as a limitation. Numerous additions, substitutions and other changes can be made to the invention without departing from its scope as set forth in the appended claims.

We claim:

1. A carbody and crawler assembly comprising:

a carbody comprising:

a first beam with a first end; and a second beam with a first end;

a first crawler assembly attached to said first end of said first beam, wherein said first crawler assembly comprises a first crawler track that is constrained to move along a single linear path relative to said first beam; and a second crawler assembly that directly contacts said first crawler assembly and is attached to both said first crawler assembly and said first end of said second beam.

2. The carbody and crawler assembly of claim 1, wherein said first crawler assembly comprises a central frame and said first crawler track on a first side of said central frame and a second crawler track on a second side opposite said first side of said central frame.

3. The carbody and crawler assembly of claim 2, wherein said second crawler assembly comprises a second central frame and a third crawler track on a first side of said second central frame and a fourth crawler track on a second side opposite said first side of said second central frame.

4. The carbody and crawler assembly of claim 2, wherein said first crawler assembly comprises:

a first motor configured to move said first crawler track; and a second motor configured to move said second crawler track.

5. The carbody and crawler assembly of claim 4, wherein said first motor and said second motor are configured to move said first and second crawler tracks in unison.

6. The carbody and crawler assembly of claim 3, wherein said first crawler assembly comprises:

a first motor configured to move said first track; and a second motor configured to move said second track; said second crawler assembly comprises:

a third motor configured to move said third track; and a fourth motor configured to move said fourth track.

7. The carbody and crawler assembly of claim 6, wherein said first, second, third and fourth motors are configured to move said first, second, third and fourth crawler tracks in unison.

8. The carbody and crawler assembly of claim 1, wherein said first crawler assembly is aligned with said second crawler assembly and said second crawler assembly is constrained to travel along said single linear path.

9. The carbody and crawler assembly of claim 1, wherein said first crawler assembly comprises a first crawler track and a first motor configured to moves said first crawler track; and wherein said second crawler assembly comprises a second crawler track and a second motor configured to move said second crawler track.

10. The carbody and crawler assembly of claim 9, wherein said first motor and said second motor are configured to move said first and second crawler tracks in unison.

11. A carbody and crawler assembly comprising:

a carbody comprising:

a first beam with a first end; and a second beam with a first end;

a first crawler assembly attached to said first end of said first beam;

a second crawler assembly directly contacting said first crawler assembly and attached to both said first crawler assembly and said first end of said second beam;

a horizontal female member;

a male attachment device extending through said horizontal female member so that said first crawler assembly is connected to said second crawler assembly; and said male attachment device and horizontal female member having a cooperating shape that ensures that said male attachment device will extend through said female member when said first crawler assembly and said second crawler assembly are positioned with respect to each other at a range of angles from 5 to 45 degrees from their operational position.

12. The carbody and crawler assembly of claim 11, wherein said male attachment device and horizontal female member have a shape that ensures that said male attachment device will extend through said female member when said first crawler assembly and said second crawler assembly are positioned with respect to each other at a range of angles from 5 to 15 degrees from their operational position.

13. The carbody and crawler assembly of claim 11, wherein said male attachment device comprises a stationary pivot point element.

14. The carbody and crawler assembly of claim 11 wherein said female member comprises an elongated opening.

15. The carbody and crawler assembly of claim 13, wherein said stationary pivot point element comprises a vertically extending pin.

16. The carbody and crawler assembly of claim 15 wherein an end of said pin has a chamfered shape.

17. The carbody and crawler assembly of claim 1, wherein said carbody is H-shaped comprising a central support structure attached to said first and second beams.

18. The carbody and crawler assembly of claim 1, wherein said first beam and said second beam are integrally attached to said carbody.

19. The carbody and crawler assembly of claim 1, wherein said first beam and said second beam are detachable from said carbody.

20. The carbody and crawler assembly of claim 17, wherein said central support structure is perpendicular to said first and second beams.

* * * * *